US010937263B1

(12) United States Patent
Tout et al.

(10) Patent No.: US 10,937,263 B1
(45) Date of Patent: Mar. 2, 2021

(54) SMART CREDENTIALS FOR PROTECTING PERSONAL INFORMATION

(71) Applicant: Amazon Technologies, Inc., Seattle, WA (US)

(72) Inventors: Sean Hicham-Refaat Tout, Seattle, WA (US); Jason Eric White, North Bend, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/144,957

(22) Filed: Sep. 27, 2018

(51) Int. Cl.
*G07C 9/28* (2020.01)

(52) U.S. Cl.
CPC ..... *G07C 9/28* (2020.01)

(58) Field of Classification Search
None
See application file for complete search history.

(56) References Cited

U.S. PATENT DOCUMENTS 5,301,114 A 4/1994 Mitchell
5,592,408 A * 1/1997 Keskin ..... G06K 19/077 365/52
7,207,480 B1 * 4/2007 Geddes ..... G06Q 20/32 235/379
7,409,291 B2 8/2008 Pasolini et al.
7,578,446 B2 * 8/2009 Yen ..... G06K 19/077 235/486
8,070,061 B2 * 12/2011 Habraken ..... G06Q 20/327 235/375
8,136,735 B2 * 3/2012 Arai ..... G06K 19/07718 235/492
8,191,789 B2 * 6/2012 Couck ..... G06K 19/041 235/492
8,321,128 B2 11/2012 Park
8,941,465 B2 * 1/2015 Pineau ..... G06F 21/32 340/5.2
9,129,230 B2 * 9/2015 Lewis ..... G06Q 10/00
9,224,084 B2 * 12/2015 Warther ..... G06K 7/10366
9,311,586 B2 * 4/2016 Robinette ..... G08B 13/1427
9,489,609 B2 * 11/2016 Glaser ..... G06F 21/32
9,529,089 B1 12/2016 Buether
9,646,444 B2 * 5/2017 Ortiz ..... G06Q 10/06
9,762,713 B2 * 9/2017 Lambert ..... H04B 1/3877
2004/0172167 A1 9/2004 Pasolini et al.
2007/0175983 A1 * 8/2007 Klug ..... G06K 19/07 235/380

(Continued)

*Primary Examiner* — K. Wong
(74) *Attorney, Agent, or Firm* — Athorus, PLLC

(57) ABSTRACT

A smart credential is programmed to show personal information regarding a user on a display when such information is desired or required, and to conceal some or all of the personal information of the user at other times. The information displayed by the credential may pertain to a location of the credential, a level of authorization of the user, or a task or function to be performed by the user. When the credential executes a handshake with a beacon at a secure facility, relevant information regarding the location, the level of authorization, the task or the function is displayed on the credential, and irrelevant information is not displayed. Additionally, a signature of motion by a bearer of a credential may be compared to a signature of motion of an authorized user of the credential in order to determine whether the bearer of the credential is the authorized user.

20 Claims, 24 Drawing Sheets

(56) References Cited

U.S. PATENT DOCUMENTS

| | | | | |
|---|---|---|---|---|
| 2008/0059068 | A1 | 3/2008 | Strelow et al. | |
| 2009/0005985 | A1 | 1/2009 | Basnayake | |
| 2009/0247186 | A1 | 10/2009 | Ji et al. | |
| 2010/0012573 | A1 | 1/2010 | Dendel et al. | |
| 2010/0057360 | A1 | 3/2010 | Ohkubo | |
| 2010/0121573 | A1 | 5/2010 | Imafuku et al. | |
| 2010/0125403 | A1 | 5/2010 | Clark et al. | |
| 2010/0241355 | A1 | 9/2010 | Park | |
| 2010/0250134 | A1 | 9/2010 | Bornstein et al. | |
| 2010/0312461 | A1 | 12/2010 | Haynie et al. | |
| 2011/0066377 | A1 | 3/2011 | Takaoka | |
| 2011/0071759 | A1 | 3/2011 | Pande et al. | |
| 2011/0112764 | A1 | 5/2011 | Trum | |
| 2011/0125403 | A1 | 5/2011 | Smith | |
| 2011/0208496 | A1 | 8/2011 | Bando et al. | |
| 2012/0181333 | A1* | 7/2012 | Krawczewicz .... | G06K 19/0718 235/380 |
| 2013/0214925 | A1 | 8/2013 | Weiss | |
| 2014/0095009 | A1 | 4/2014 | Oshima et al. | |
| 2017/0228953 | A1* | 8/2017 | Lupovici ..... | G07C 9/00309 |

* cited by examiner

SMART CREDENTIALS FOR PROTECTING PERSONAL INFORMATION

BACKGROUND

Identification badges (or tags), such as identification badges used by employees to enter and exit office buildings, are devices that are commonly worn or carried by users to visually present information regarding such users to others. Traditionally, an identification badge may include one or more of a name of a user (e.g., a first name and/or last name), a photograph of the user (e.g., a facial shot), a professional title of the user, or other information regarding the user, such as contact information in the form of electronic mail addresses or telephone numbers. More recently, identification badges have also included one or more readable devices or systems such as bar codes (e.g., one-dimensional or two-dimensional bar codes, such as "QR" codes), magnetic strips or radiofrequency identification (or "RFID") transmitters that are encoded or programmed with information that may be interpreted by one or more readers or other machines. An identification badge is typically joined to a clip, a chain, a lanyard, a belt loop, or another device that enables the badge to be worn or carried by a user, such as an employee or another worker in an office building.

Identification badges are typically issued to users for at least three reasons. First, an identification badge may be used to enable access to one or more buildings or other secure facilities. For example, a bearer may present an identification badge to a security guard or other staff member, who may review the badge to determine whether the badge is authentic, valid or unexpired, or whether the badge is associated with the bearer, before permitting the bearer to access the building or secure facility. Alternatively, or additionally, an identification badge that includes a bar code, a magnetic strip or an RFID transmitter may be swiped, scanned or otherwise placed within a proximity of an associated reader prior to enabling a bearer to access a building or a secure facility. Next, an identification badge that includes a name and/or a photograph of a user may be visually evaluated by a security guard or other personnel that are located within a building or secure facility in order to confirm that a bearer of the identification badge is the user, or that the bearer is authorized to be present within the building or the secure facility. Finally, an identification badge may facilitate social or professional interactions between two or more bearers of such badges, in that an identification badge that includes a name or a title of a bearer enables others to readily learn the name or title of that bearer, while an identification badge that includes a telephone number, electronic mail address or alias, or social media account name of a bearer visually provides others with necessary information to contact the bearer at later times, if necessary.

The use of identification badges by an organization may occasionally result in undue or unwanted stresses within the organization, however, where an organization hosts an event that is attended by a large number of visitors who are not likely to return to the organization at later times, or where an organization regularly requires the assistance of workers, contractors or other individuals on a short-term basis. In such instances, the visitors, workers and/or contractors must be issued identification badges, even on a temporary basis, and organizers of the event, security guards or other personnel will rely on such identification badges to determine whether a visitor, a worker, a contractor or another individual is authorized or unauthorized. Depending on the depth and richness of data that is to be presented on or made available by the identification badges, issuing such badges to a large number of visitors, workers and/or contractors requires the collection of names, titles, images or other data of such bearers, the generation of bar codes or magnetic strips, encoded with information regarding the bearers, or the programming of RFID devices with information regarding the bearers, and forming the identification badges to include the names, titles, images or other data, as well as the affixation of bar codes, magnetic strips or RFID devices to such identification badges. Such processes are inherently complicated where a temporary visitor, worker or contractor is scheduled to depart from or return to a building or other secure facility on an irregular but frequent basis.

As another example, where the presence of a member of an organization (e.g., a worker or a contractor) who ordinarily performs tasks in one facility (or in one area within a facility) is required at another facility (or at another area within the facility), the member of the organization may typically require the issuance of another identification badge to access the other facility or the other area within the facility. Moreover, when an identification badge is issued to an individual on a temporary or a long-term basis, a risk of a security breach may arise where the identification badge is not timely retrieved from the individual.

DETAILED DESCRIPTION

Figure 1A:
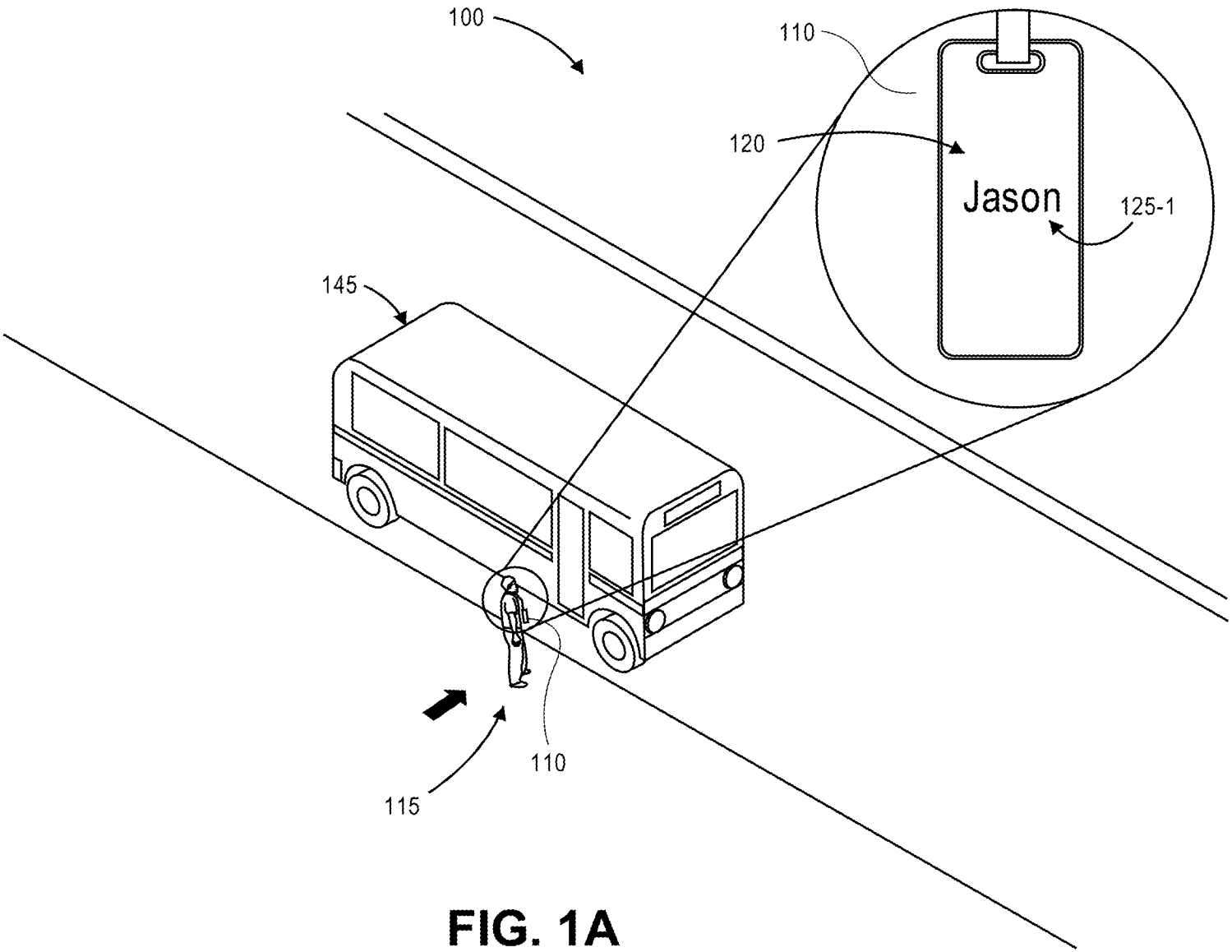
FIGS. 1A through 1F are views of one system for using smart credentials in accordance with embodiments of the present disclosure.

As is set forth in greater detail below, the present disclosure is directed to smart credentials, e.g., dynamic identification badges or tags, having features that may be configured to provide users, such as employees having workstations in an office building, with access to facilities while protecting and preserving personal information of such users. Identification badges are required by employers to keep both employees' personal information, and employers' proprietary or sensitive information, safe from uninvited visitors. While many state-of-the art security badges have a single RFID chip that enables a bearer of an identification badge to pass through secure access points, one or more of the smart credentials described herein have added functionality to further enhance the safety and security of secure facilities.

In some embodiments, a smart credential is an electronic, powered device that may be programmed to show or display context-specific information, e.g., by showing or displaying only generic information regarding a user when the smart credential is not at or near locations where pertinent or critical information is relevant or required, and by showing or displaying the pertinent or critical information regarding the user when the smart credential is at or near one or more of such locations. A smart credential may also be remotely programmed with information regarding a user, including but not limited to images, names, titles, or contact information, as well as changes to such images, names, titles, or contact information. A smart credential may also be remotely programmed with temporary or long-term statuses, clearance levels, or access information regarding a user, in order to determine when the user's access to one or more buildings or facilities has expanded or contracted accordingly. A smart credential may be further integrated with any number of scheduling systems, calendar systems or access control systems, such that a smart credential may display information regarding one or more spaces within a secure facility where a bearer is located or is expected or required to be located, and such information may be updated in real time or near-real time as demands for space or time may change.

A smart credential may be further configured with one or more sensors configured to confirm that a user of the smart credential is a person identified on the smart credential by creating a "gait signature," which may serve as a form of identification of the user. For example, position sensors and/or motion sensors may be used to confirm an identity of a user by capturing information or data from which signatures regarding a gait of the user, e.g., a manner or pattern of foot travel by the user, may be generated and stored in association with information regarding the user. Thereafter, such sensors may further capture information or data regarding manners or patterns of foot travel by a bearer of the smart credential, and a gait signature of the bearer may be generated based on such information or data. A gait signature of a bearer of a smart credential may be compared to a gait signature of a user associated with the smart credential stored in one or more data stores, in order to determine whether the bearer is the user associated with the smart credential. A handshake by a smart credential may further act as one factor in a multi-factor authentication process, e.g., along with one or more user names and/or passwords or biometric data, to confirm an identity of a bearer of the smart credential prior to granting the bearer access to one or more secure computer systems. A smart credential may also enable one or more other factors, e.g., by interactions with a biometric sensor or other component.

Referring to FIGS. 1A through 1F, views of one system for using smart credentials to limit badge information of a user when the user is away from an access point of a secure facility, such as an office building, are shown. For example, when an employee is away from his or her office to visit a client, the smart credential will limit the information that is provided to others via the display. Referring to FIG. 1A, a smart credential 110 is worn or carried by a user 115 (e.g., a worker, a student, or other individual) who has access to a secure facility, as the user 115 boards a bus 145 (or another vehicle or means for transportation) for travel to the secure facility, from, for example, a client location. The smart credential 110 includes generic information 125-1 regarding the user 115 on a display 120. The generic information 125-1 includes a first name (or nickname) of the user 115.

Figure 1B:
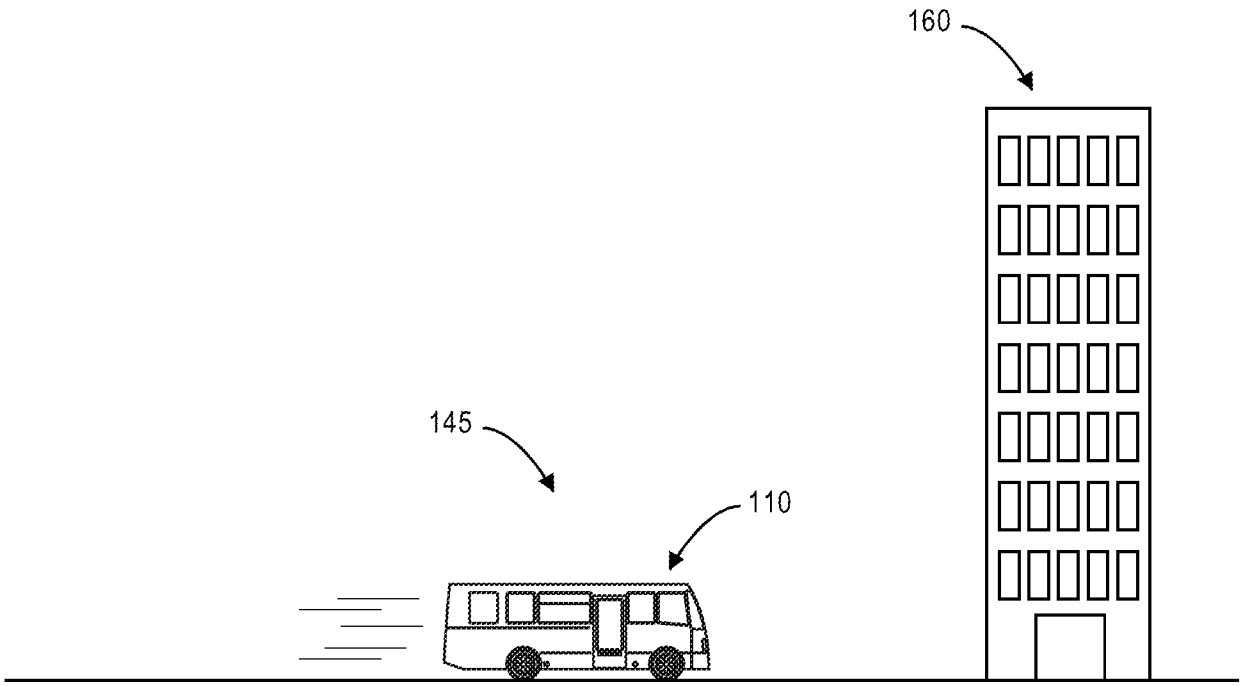

Referring to FIG. 1B, the user 115 travels from a first location (such as a client location) to a building 160 (or other secure facility) at a second location aboard the bus 145.

Figure 1C:
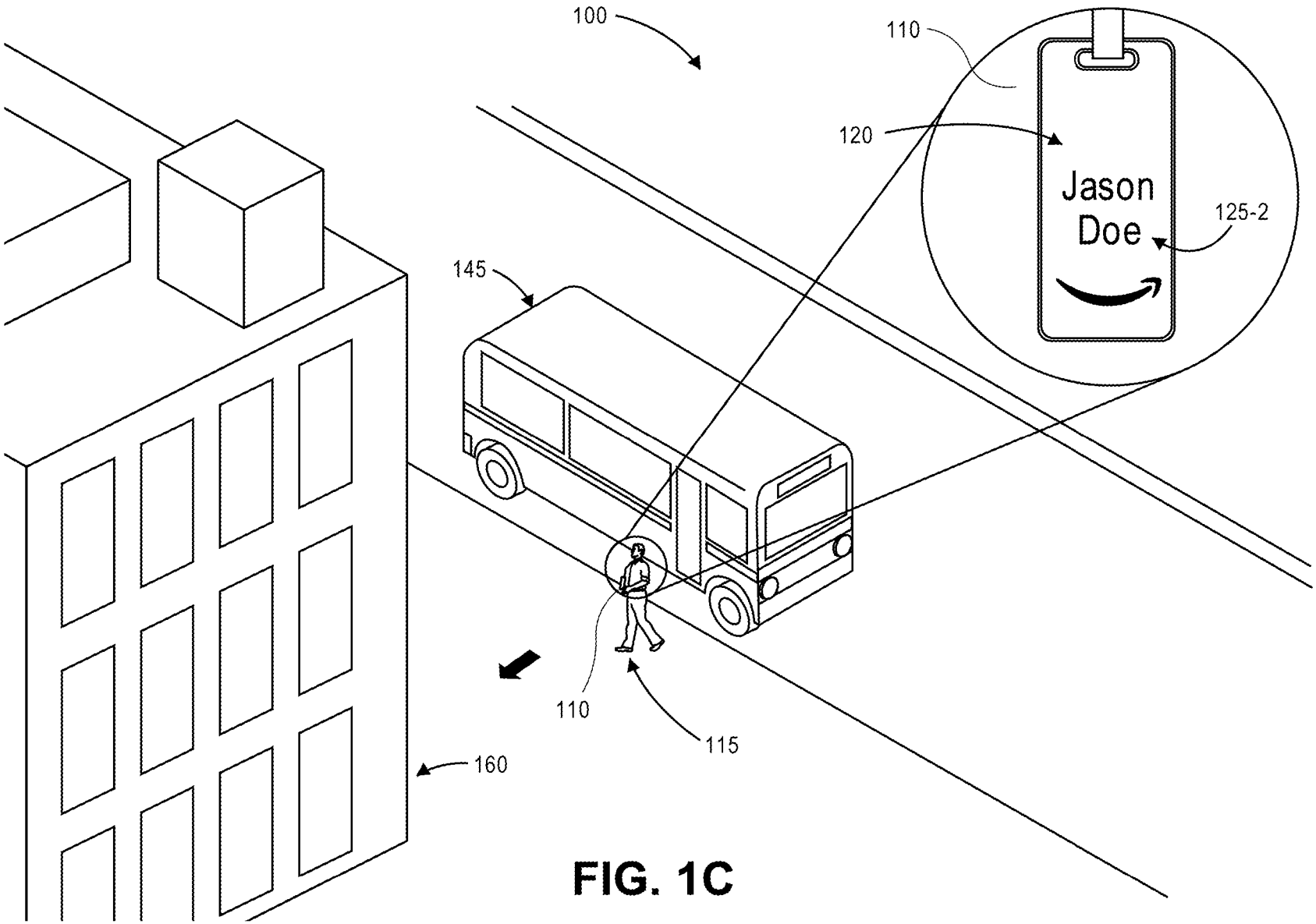

Referring to FIG. 1C, the user 115 disembarks from the bus 145 within a vicinity of the building 160, and prepares to enter the building 160. Upon determining that a position of the smart credential 110 is proximate the building 160, e.g., by communication with one or more position systems, or in any other manner, the smart credential 110 displays additional information 125-2 regarding the user 115 on the display 120. As is shown in FIG. 1C, the additional information 125-2 includes more information, or different information, than the generic information 125-1, such as a first name and a last name of the user 115, as well as a logo, trademark or symbol associated with the building 160. The smart credential 110 thus enhances the security of the personal information of the user 115, by only displaying the additional information 125-2 when the user 115 is determined to have arrived at the building 160.

Figure 1D:
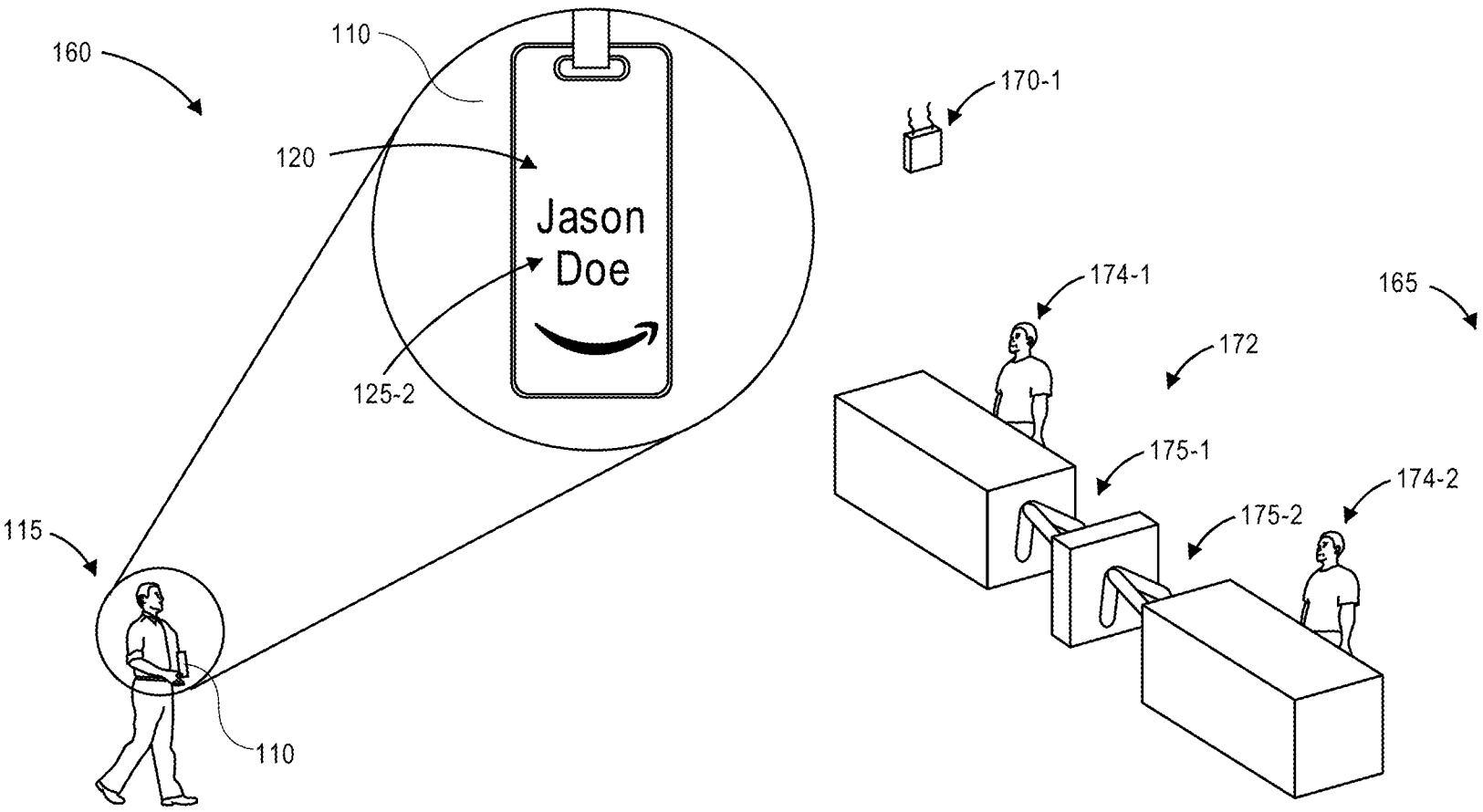

Referring to FIG. 1D, the user 115 has entered the building 160. The user 115 approaches an access point 172 to one or more secure areas (or spaces or facilities) 165 within the building 160 while bearing the smart credential 110, which includes the additional information 125-2 displayed on the display 120. A first beacon 170-1 is provided inside the building 160, and has an operating range that includes the access point 172, which is staffed by one or more security guards (or other personnel) 174-1, 174-2. The access point 172 is associated with a physical or virtual boundary or barrier to the secure area 165 within the building 160. The first beacon 170-1 may be any physical device that is configured for communication with one or more other systems, including but not limited to the smart credential 110, by one or more protocols, e.g., via radiofrequency ("RF") waves or signals such as Wireless Fidelity (or "Wi-Fi"), RFID, Bluetooth®, near-field communication (or "NFC") signals, or in any other manner. The access point 172 has a pair of access control systems 175-1, 175-2 (e.g., turnstiles) for permitting or inhibiting access to or from the secure area 165. The access control systems 175-1, 175-2 may also be configured for communication with the first beacon 170-1, or any other beacons, devices or systems, in a wired or wireless manner, and according to any other protocols or standards.

Figure 1E:
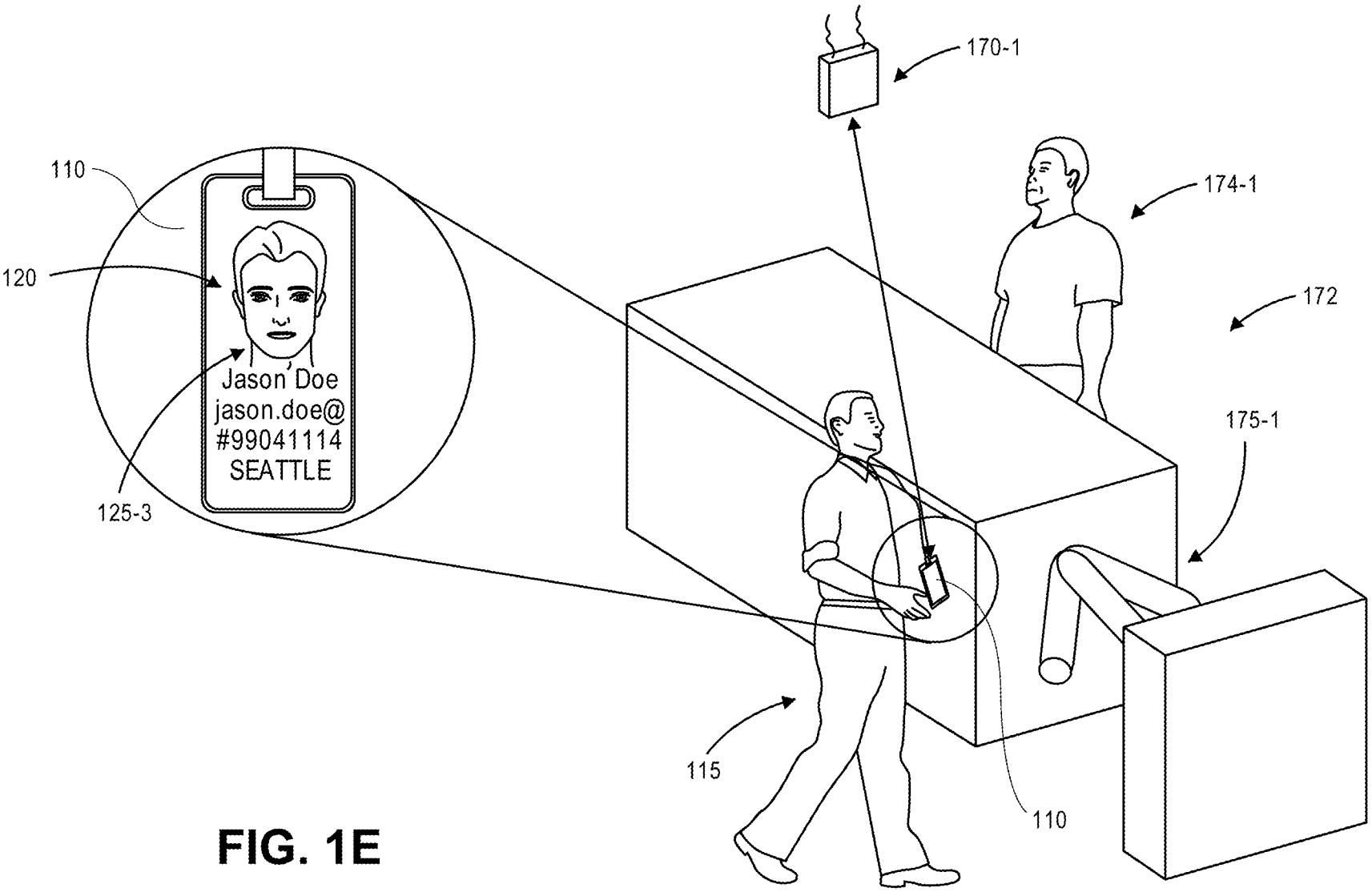

Referring to FIG. 1E, the user 115 arrives at the access point 172 and is within the operating range of the first beacon 170-1. The smart credential 110 initiates a "handshake," or an initial exchange of information, with the first beacon 170-1, which may be specifically programmed or configured to identify itself as being associated with the building 160 in general, or the secure area 165 or the access point 172 in particular. When the smart credential 110 successfully completes a handshake with the first beacon 170-1, a communications channel is opened between the first beacon 170-1 and the smart credential 110, thereby confirming that the smart credential 110 is within a vicinity of the access point 172. Alternatively, or additionally, the smart credential 110 may communicate with the first beacon 170-1, e.g., by exchanging any type or form of information or data therebetween, and thereby confirming that the smart credential 110 is within a vicinity of the access point 172.

Upon confirming that the smart credential 110 is within a vicinity of the access point 172, e.g., based on a successful handshake with the first beacon 170-1, or in any other manner, the smart credential 110 displays detailed information 125-3 regarding the user 115 on the display 120. As is shown in FIG. 1E, the detailed information 125-3 includes more information, or different information, than the additional information 125-2, such as an image of the user 115, as well as the first name and the last name of the user 115, an identification number (e.g., an employee number) of the user 115, and a location, an organizational unit or a group with which the user 115 is associated (viz., Seattle).

In accordance with the present disclosure, the smart credential 110 enhances a level of security associated with the personal information of the user 115, and also a level of security at the building 160, by displaying the detailed information 125-3 of the user 115 only after the smart credential 110 has successfully completed a handshake with the first beacon 170-1 at the access point 172. In accordance with the present disclosure, the smart credential 110 enables the security guards 174-1, 174-2 to visually evaluate the detailed information 125-3 and determine whether the user 115 corresponds to the detailed information 125-3. One or more of the security guards 174-1, 174-2 may, upon evaluating the detailed information 125-3, make an informed decision as to whether the user 115 is authorized to pass through the access point 172 and enter the secure area 165, and may operate or enable the user 115 to operate one or more of the access control systems 175-1, 175-2 accordingly. Alternatively, one or more of the access control systems 175-1, 175-2 may be in communication with the first beacon 170-1 or the smart credential 110, and may be configured for automatic operation, or configured for manual operation by the user 115, upon the successful completion of a handshake with the first beacon 170-1. Moreover, upon the successful completion of a handshake with the first beacon 170-1, information or data regarding an arrival of the user 115 at the access point 172, e.g., a time and/or a date of the handshake, as well as a geolocation or other identifier of the access point 172, may be recorded in one or more records maintained in one or more data stores.

Figure 1F:
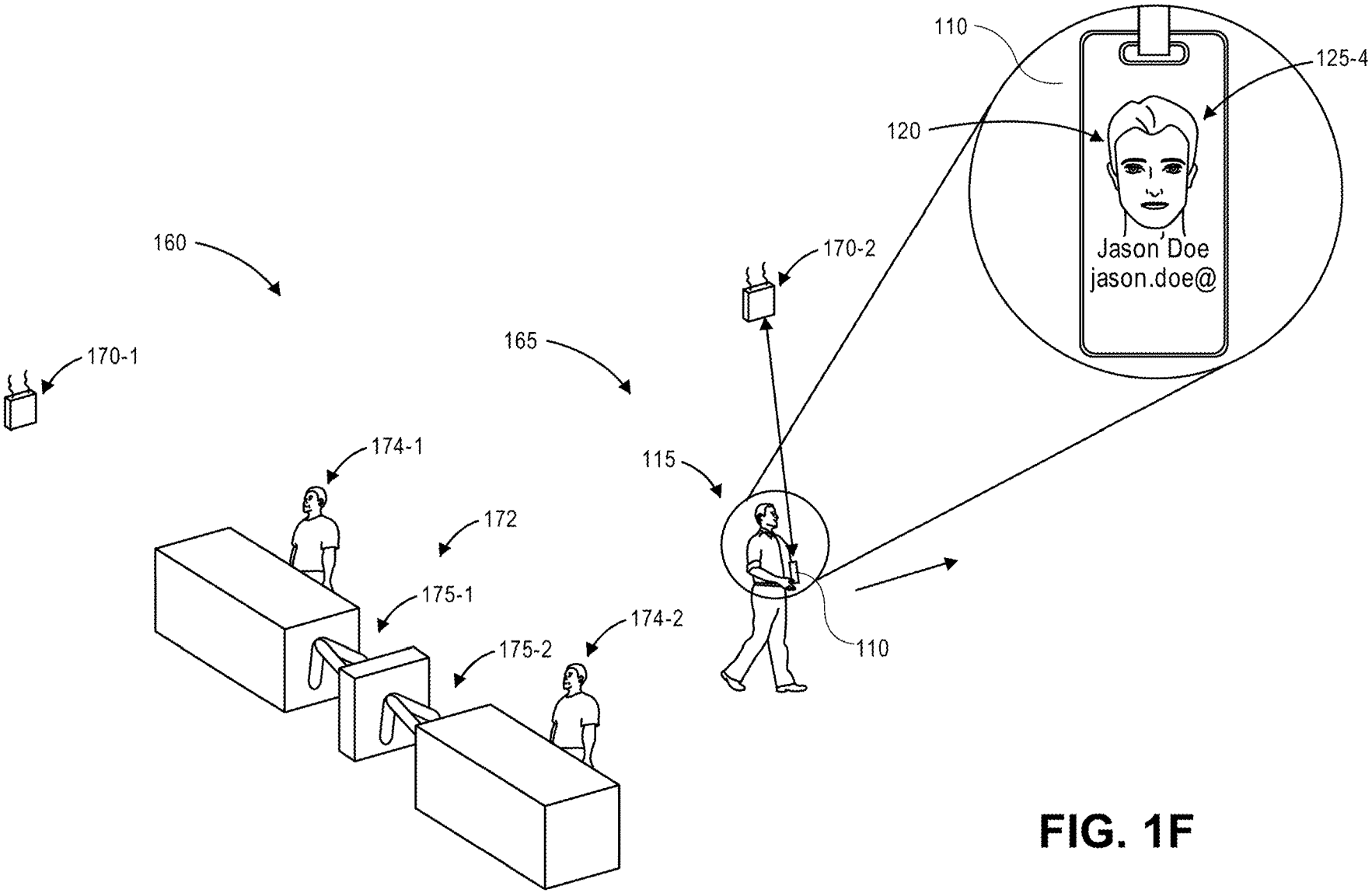

Referring to FIG. 1F, the user 115 has passed through the access point 172 while bearing the smart credential 110. As is shown in FIG. 1F, the smart credential 110 initiates another handshake with a second beacon 170-2, thereby opening a channel for communication between the second beacon 170-2 and the smart credential 110 by any number of protocols or standards, e.g., Wi-Fi, RFID, Bluetooth® or NFC, or any others. The second beacon 170-2 may be specifically programmed or configured to identify itself as being associated with the building 160 in general, or to identify itself as being associated with one or more specific locations beyond a boundary or barrier associated with the access point 172. Upon successfully completing a handshake with the second beacon 170-2, the smart credential 110 may display operating information 125-4 regarding the user 115 on the display 120. The smart credential 110 thus further enhances a level of security associated with the personal information of the user 115, and also a level of security at the building 160, by displaying the operating information 125-4 of the user 115 only after the smart credential 110 has successfully completed a handshake with the second beacon 170-2, beyond the access point 172. The operating information 125-4 may include the same information as the detailed information 125-3 or, as is shown in FIG. 1F, may exclude information that is not required for viewing or interpretation by the security guards 174-1, 174-2, e.g., the identification number or the group with which the user 115 is associated, or which may not be required for any tasks or functions to be performed by the user 115 within the secure area 165.

Subsequently, the smart credential 110 may initiate and complete any number of additional handshakes with other beacons (not shown) provided in other locations within the secure area 165, thereby opening one or more communications channels with such beacons, and causing other information to be displayed on the display 120, as such information may be necessary or relevant for one or more tasks or functions to be performed by the user 115 at such locations, or removing other information from the display 120, as such information is no longer necessary or relevant for one or more tasks or functions to be performed by the user 115.

As described above, a gait signature may be stored in association with the user 115 and compared to information or data regarding gaits of one or more bearers of the smart credential 110, or signatures generated based on such information or data, to ensure that information stored on or accessible to the smart credential 110 is only made available to the user 115, or that access rights associated with the smart credential 110 are only granted to the user 115. A measure of confidence that a bearer of the smart credential 110 is the user 115 may be calculated based on a comparison of one or more gait signatures generated based on the motion of the smart credential 110, as worn by a bearer, to one or more gait signatures associated with the user 110. If the measure of confidence exceeds one or more predetermined thresholds, it may be inferred that the bearer of the smart credential 110 is the user 115, and information or data stored on or accessible to the smart credential 110 may be made available to the bearer, or that access rights associated with the smart credential 110 are granted to the bearer. If the measure of confidence falls below one or more predetermined thresholds, however, it may be inferred that the bearer of the smart credential 110 is not the user 115, and one or more measures may be taken accordingly. Additionally, when the user 115 attempts to log into a secure computer system within the secure area 165, e.g., by entering a user name and password, a personal identification number (or "PIN"), biometric data, or another identifier, a handshake initiated and successfully completed between the smart credential 110 and one or more beacons within the secure area 165 may act as a secondary factor in a multi-factor authentication process. The user 115 may be granted access to the secure computer system when the user name and password, the PIN, the biometric data or the other identifier are accepted, and where a handshake has been successfully completed with the smart credential 110.

Additionally, when the user 115 has completed any relevant tasks or functions within the secure area 165, or where the presence of the user 115 is neither required nor desired within the secure area 165, the user 115 may depart the building 160 by way of the access point 172 or any other access points (not shown). For example, as the user 115 prepares to depart the secure area 165 by way of the access point 172, the smart credential 110 may initiate another handshake with the first beacon 170-1. Following the successful completion of the handshake with the first beacon 170-1, relevant information (e.g., the additional information 125-2 or the detailed information 125-3) may be shown on the display 120 of the smart credential 110, and one or more records may be updated to reflect the departure of the user 115, e.g., by recording a time and/or a date of the handshake, as well as a geolocation or other identifier of the access point 172, in such records. As the user 115 exits the building 160, other information, e.g., the generic information 125-1 or the additional information 125-2, may be shown on the smart credential 110.

Accordingly, the systems and methods of the present disclosure are directed to the use of "smart" credentials that are configured to display information regarding a user on an as-needed basis, and to protect or conceal information regarding the user where such information is neither desired nor required, thereby further enhancing levels of security associated with secure facilities that depend on such information to grant or deny access. A smart credential may be initially programmed with information regarding a user, or programmed with updated information regarding the user, by one or more wired or wireless systems. When a smart credential determines a context in which the smart credential is located or to be used, e.g., based on one or position sensors and/or handshakes executed with one or more beacons, the smart credential may be configured to display relevant context-specific information associated with a user that is relevant to that location or use, and to conceal or withhold all other information.

In accordance with some embodiments of the present disclosure, a smart credential may include a frame or a housing formed from any suitable material, and including any type or form of display apparatus. For example, a frame or housing may be formed from injection molding, or by any other form of forming or molding (e.g., rotational molding, extrusion molding, vacuum casting, thermoforming, compression molding) of any type of materials. In some embodiments, a frame or housing may be formed from plastics (e.g., thermosetting plastics such as epoxy or phenolic resins, polyurethanes or polyesters, as well as polyethylenes, polypropylenes or polyvinyl chlorides), metals (e.g., metals such as aluminum or aluminum alloys, e.g., aluminum 6063, or metals of heavier weights such as alloys of steel), wood, composites or any other combinations of materials. The displays may be any type or form of system for electronically displaying information that may be disposed in a frame or housing.

In addition to frames or housings and displays, a smart credential may include any number of devices or components, including but not limited to one or more processors or processing units, which may be coupled to a display and also one or more memory devices or data stores, and transceivers configured to enable the smart credential to communicate through one or more wired or wireless means, e.g., wired technologies such as Universal Serial Bus (or "USB") or fiber optic cable, as well as standard wireless protocols or standards such as Wi-Fi, RFID, Bluetooth®, NFC, or any other protocols or standards.

In accordance with some embodiments of the present disclosure, a smart credential may be configured for communication with a beacon (e.g., a communications beacon) that may be of any size, shape or dimension, and may include controllers, processors, transmitters and/or receivers and power sources that are configured to transmit or receive signals at any intensity or frequency, or to operate for any duration. The beacons may be mounted in association with buildings and/or secure facilities, e.g., at access points or throughout one or more spaces therein. The beacons may be configured to communicate (e.g., to transmit or receive signals) according to any communications protocol or standard.

In some embodiments, a smart credential may be programmed with information regarding a user for use in a variety of contexts, including but not limited to a name (e.g., a first name, a last name, a nickname) of the user, and one or more identifiers of functions, roles, titles or capacities of the user (e.g., "Supervisor," "Vice President," "Engineer," "Intern," "Security," as well as special designations like "Floor Safety Coordinator," or the like). The smart credential may be further programmed to display some or all of such information in association with one or more selected positions, which may be determined using a position sensor (e.g., a receiver of signals from one or more beacons), or following a successful handshake or other interaction with a beacon. The information to be displayed may be selected based on the determined position. Thus, a smart credential may be configured to display only the information regarding a user that is relevant and required at a given position, and may conceal other information regarding the user that is neither relevant nor required at the position. A smart credential may also be programmed to receive and accept changes in information regarding a user, such as when changes are observed in a user's name, attributes or features, functions, roles, titles or capacities, as well as a new image of the user at regular times or when specified or directed by the user or one or more other personnel (e.g., a supervisor of the user). A smart credential may be further programmed to receive and accept temporary or long-term statuses, clearance levels, or access information regarding a user, in order to determine when the user's access to one or more buildings or facilities has expanded or contracted accordingly.

The types or forms of applications in which smart credentials may be utilized to selectively display selected personal, context-specific information of users at specific locations, and to conceal or withhold other personal information of the users from others at such locations, are not limited.

Figure 2A:
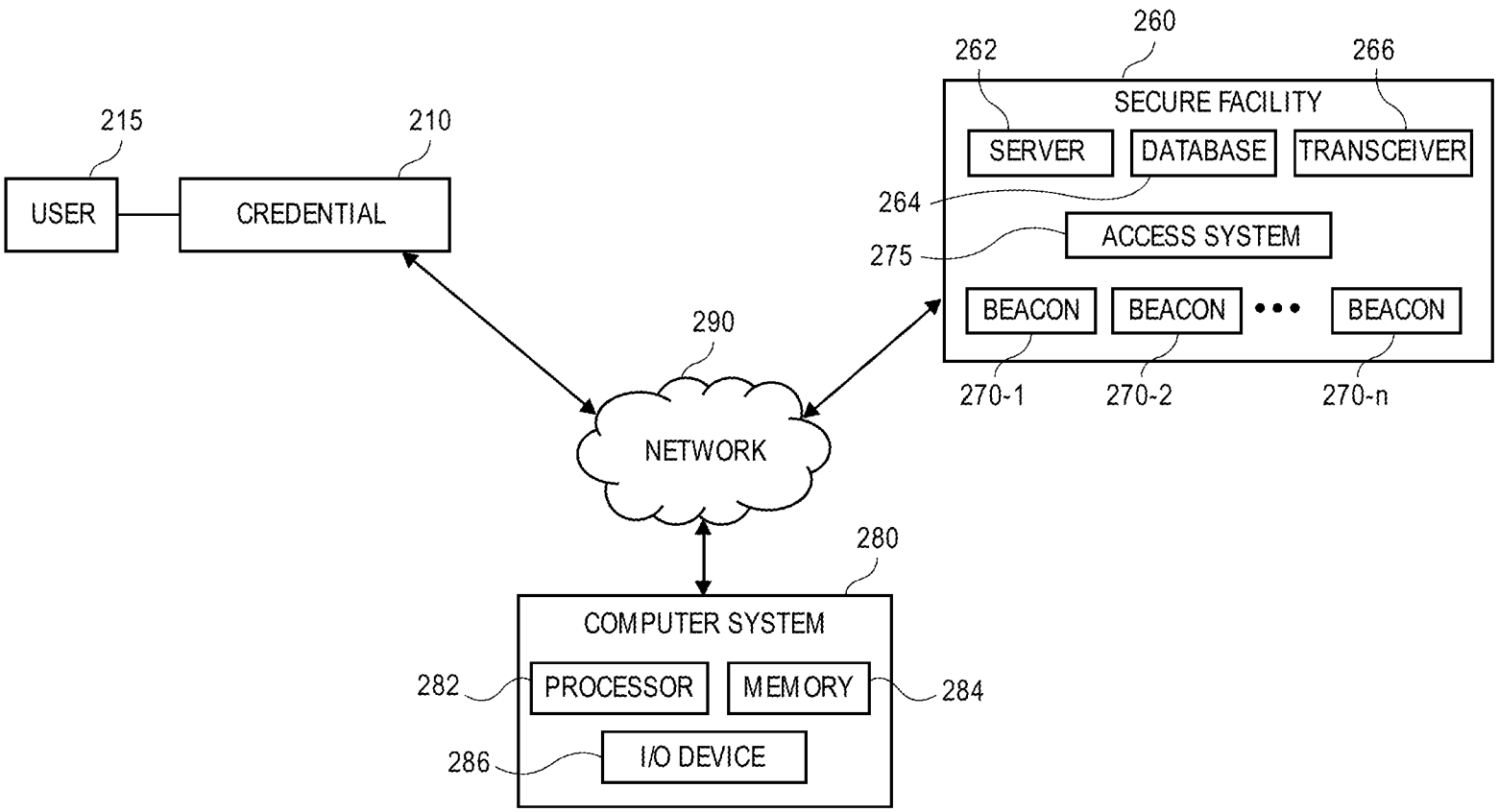
FIGS. 2A and 2B are block diagrams of components of one system for using smart credentials in accordance with embodiments of the present disclosure.
Figure 2B:
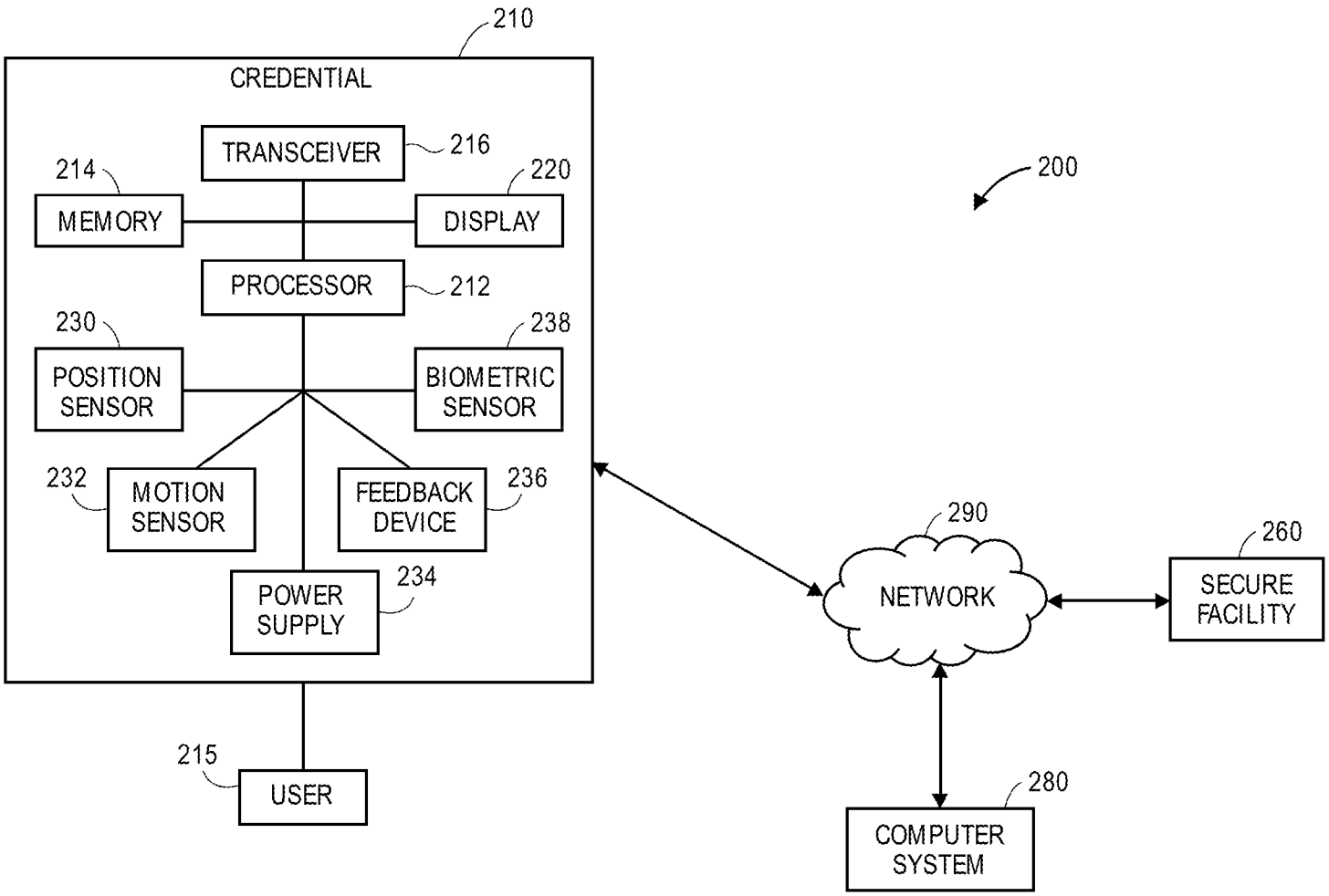

Referring to FIGS. 2A and 2B, block diagrams of components of one system for using smart credentials in accordance with embodiments of the present disclosure are shown. Except where otherwise noted, reference numerals preceded by the number "2" in FIG. 2A or FIG. 2B refer to elements that are similar to elements having reference numerals preceded by the number "1" shown in FIGS. 1A through 1F.

As is shown in FIGS. 2A and 2B, the system 200 includes a smart credential 210, a secure facility 260 and a computer system 280 that are connected to one another over one or more networks 290, which may include the Internet in whole or in part. The smart credential 210 is associated with a user 215.

The smart credential 210 includes a processor 212, a memory 214, a transceiver 216 and a display 220. The smart credential 210 further includes a position sensor 230, a motion sensor 232, a power supply 234, a feedback device 236 and a biometric sensor 238. The secure facility 260 includes a plurality of beacons 270-1, 270-2 . . . **270-*n*, and an access system 275**.

The processor 212 may be configured to perform any type or form of computing function, including but not limited to the execution of one or more machine learning algorithms or techniques, for controlling any aspects of the operation of the smart credential 210 and any computer-based components thereon, such as the memory 214, the transceiver 216, the display 220, the position sensor 230, the motion sensor 232, the power supply 234, the feedback device 236 and/or the biometric sensor 238. The processor 212 may further control any aspects of the operation of any number of additional components that may be provided on the smart credential 210 (not shown), e.g., one or more other sensors, illuminators (e.g., lights), or the like. In some embodiments, the processor 212 may be configured to initiate a handshake with one or more of the beacons 270-1, 270-2 . . . 270-*n*, e.g., by exchanging one or more packets of information or data to the one or more of the beacons 270-1, 270-2 . . . 270-*n*, or by receiving one or more packets of information or data from one or more of the beacons 270-1, 270-2 . . . 270-*n*, using the transceiver 216. A successfully completed handshake may open up a communications channel between the smart credential 210 and one or more of the beacons 270-1, 270-2 . . . 270-*n*.

In some embodiments, the processor 212 may be configured to determine that a handshake has been accepted or refused by one or more beacons associated with a given location, and to execute one or more actions in response to the acceptance or refusal, e.g., to transfer data according to one or more protocols or standards, such as Transmission Control Protocol (or "TCP"), Transport Layer Security (or "TLS"), Secure Sockets Layer ("or "SSL"), or the others. In some embodiments, the processor 212 may be configured to determine a location of the smart credential 210, e.g., based on one or more signals received by the position sensor 230, and to execute one or more actions based on the determined location. In some embodiments, the processor 212 may be configured to generate a signature of one or more patterns of motion of the user 215, based on information or data regarding accelerations, velocities or locations of the motion of the user 215, as determined by one or more of the position sensor 230 and/or the motion sensor 232.

The processor 212 may be a uniprocessor system including one processor, or a multiprocessor system including several processors (e.g., two, four, eight, or another suitable number), and may be capable of executing instructions. For example, in some embodiments, the processor 212 may be a general-purpose or embedded processor implementing any of a number of instruction set architectures (ISAs), such as the x86, PowerPC, SPARC, or MIPS ISAs, or any other suitable ISA. Where the processor 212 is a multiprocessor system, each of the processors within the multiprocessor system may operate the same ISA, or different ISAs.

The memory or storage components 214 (such as databases or data stores) may be configured to store any type of information or data regarding the user 215, e.g., one or more images of the user 215, one or more names (e.g., a first name, a last name, a nickname) of the user 215, one or more identifiers (e.g., worker identification numbers) of the user 215, or one or more attributes of the user 215, for use in any context in which the smart credential 210 may be utilized. In some embodiments, the memory 214 may be configured to store information or data regarding a gait of the user 215, or patterns of motion of the user 215, e.g., signatures generated based on information or data regarding accelerations, velocities or locations of the motion of the user 215, as determined by one or more of the position sensor 230 and/or the motion sensor 232. The memory 214 may also be configured to store packets of information or data for transmitting in one or more handshake processes, e.g., with one or more beacons, or information or data received from one or more beacons in one or more handshake processes. The memory 214 may be further configured to store any other data items accessible by or to the processor 212. The memory 214 may be implemented using any suitable memory technology, such as static random access memory (SRAM), synchronous dynamic RAM (SDRAM), nonvolatile/Flash-type memory, or any other type of memory. Information or data stored in the memory 214 may be generated by one or more of the position sensor 230 and/or the motion sensor 232, or received or transmitted via the transceiver 216, e.g., by transmission media or signals, such as electrical, electromagnetic, or digital signals, which may be conveyed via a communication medium such as a wired and/or a wireless link.

The transceiver 216 may be configured to enable the smart credential 210 to communicate through one or more wired or wireless means, e.g., wired technologies such as Universal Serial Bus (or "USB") or fiber optic cable, or standard wireless protocols or standards such as any Bluetooth® or Wi-Fi protocol or standard, such as over the one or more networks 290 or directly. The transceiver 216 may further include or be in communication with one or more input/output (or "I/O") interfaces, network interfaces and/or input/output devices, and may be configured to allow information or data to be exchanged between one or more of the components of the smart credential 210, or to one or more other computer devices or systems, e.g., the server 262, the database 264 and/or the transceiver 266 of the secure facility 260, one or more of the beacons 270-1, 270-2 . . . 270-*n*, or the access system 275, via the network 290. For example, in some embodiments, the transceiver 216 may be configured to coordinate I/O traffic between the processor 212 and one or more onboard or external computer devices or components. The transceiver 216 may perform any necessary protocol, timing or other data transformations in order to convert data signals from a first format suitable for use by one component into a second format suitable for use by another component. In some embodiments, the transceiver 216 may include support for devices attached through various types of peripheral buses, e.g., variants of the Peripheral Component Interconnect (PCI) bus standard or the Universal Serial Bus (USB) standard. In some other embodiments, functions of the transceiver 216 may be split into two or more separate components, or incorporated directly into the processor 212.

In some embodiments, the transceiver 216 may transmit and/or receive Wi-Fi signals, RFID signals, Bluetooth® signals, NFC signals, or any other type or form of signals within any frequency spectra or having any intensity or center frequency. The transceiver 216 may include any number of processors, chips (e.g., chipsets) or other components that are commonly associated with or required for communication according to a selected communications protocol or standard, or programmed as necessary (e.g., with one or more applications and/or sets of instructions) in order to communicate according to the selected protocol or standard. The signals transmitted and/or received by the transceiver 216 may be of any kind or type, and may be sent over the one or more networks 290 or directly to one or more of the beacons 270-1, 270-2 . . . 270-*n*.

The display 220 may be any type or form of system for electronically displaying information, including but not limited an electronic ink display, a liquid crystal display (or "LCD"), a light-emitting diode (or "LED") display, an organic light-emitting diode (or "OLED") display. The display 220 may be configured to display any type or form of context-specific information regarding the user 215 or the credential 210.

The beacons 270-1, 270-2 . . . 270-*n* are any devices or systems that are configured to engage in communications with the smart credential 210 over the one or more networks 290, according to any protocol or standard, e.g., Wi-Fi, RFID, Bluetooth®, NFC, or any other protocol or standard. For example, in some embodiments, one or more of the beacons 270-1, 270-2 . . . **270-*n* may be a router, e.g., a wireless router, for engaging in communications via Wi-Fi or another wireless technology, where the smart credential 210 is so configured. In some embodiments, one or more of the beacons 270-1, 270-2 . . . 270-*n* may include one or more RFID transmitters and/or receivers that are programmed to transmit or receive one or more RFID signals, where the smart credential 210 is so configured. In some embodiments, one or more of the beacons 270-1, 270-2 . . . 270-*n* may include one or more NFC chips, antennas, memory components, boards or the like, and may be configured to engage in NFC communications with the smart credential 210, where the smart credential 210 is so configured. In some embodiments, one or more of the beacons 270-1, 270-2 . . . 270-*n* may include one or more Bluetooth®-enabled components that are configured to engage in short-range, server-free, inter-device communication with the smart credential 210, e.g., directly, as a master or as a slave, or as part of a piconet, a scatternet, or another network, with or without pairing, where the smart credential 210 is so configured. In some other embodiments, such signals may be transmitted according to the Ultra-Wideband (UWB, or digital pulse wireless) standard, e.g., within a frequency spectrum of approximately 3.1 to 10.6 gigahertz (GHz), with bandwidths of at least five hundred megahertz (500 MHz), or at least twenty percent of a center frequency. In still other embodiments, such signals may be transmitted according to a long-range, low-power (e.g., LoRa) standard, e.g., at approximately nine hundred two to nine hundred twenty-eight megahertz (902-928 MHz) in the United States, or in one or more other bands Each of the beacons 270-1, 270-2 . . . 270-*n* may also be configured to execute any algorithms, techniques and/or functions, perform any tasks or calculations, or take any other steps that may be required in order to transmit or receive signals, e.g., to or from the smart credential 210, or to transmit or receive any other information, e.g., to or from the smart credential 210 or one or more other computer devices or systems over the one or more networks 290, in accordance with one or more of the embodiments disclosed herein. As is discussed above, each of the beacons 270-1, 270-2 . . . 270-*n* may include one or more processors, memory components, transceivers, power supplies or other components that may be provided individually or in association with one or more discrete circuits, e.g., printed circuit boards (or PCBs), within a frame or structure of a respective one of the beacons 270-1, 270-2 . . . 270-*n***.

The access system 275 may be one or more systems for controlling access (e.g., inhibiting or allowing access) to the secure facility 260 or one or more portions thereof. The access system 275 may be a gate (e.g., a manual or automatic gate that may be articulated, swinging, sliding or of any other form), a turnstile (e.g., a baffle gate), a door (e.g., standard doors or automatic doors, as well as swinging doors, revolving doors, garage doors or other access doors), or any other systems, as well as any electrometrical components for automatically operating such gates, turnstiles or doors. The access system 275 may be used to grant or deny access to the secure facility 260, e.g., an external gate, turnstile or door, or to grant or deny access to one or more specific spaces within the secure facility 260, e.g., an internal gate, turnstile or door. The access system 275 may further include any other systems associated with other openings to the secure facility 260.

In some embodiments, the access system 275 may be manually operated, or may be automatically operated under the control of the servers 262, which may include one or more computer processors. For example, one or more of the access systems 275 may be in communication with the smart credential 210 or the one or more servers 262, e.g., by way of the transceiver 216 and the transceiver 266, and may transmit or receive one or more signals or instructions associated with their respective operations, e.g., to or from the smart credential 210 or the servers 262. Alternatively, the access system 275 may be operated based at least in part on manual or automatic inputs provided by the user 215, or another authorized individual at the secure facility 260, e.g., by way of one or more input/output devices, which may be configured to receive and provide information to the user 215, or any other individuals or entities at the secure facility 260. Such input/output devices may include, but are not limited to, a display, (e.g., a touch-screen display), a scanner, a keypad, a biometric scanner, an audio transducer, one or more speakers, one or more imaging devices such as a video camera, and any other types of input or output devices that may support interaction between the user 215, the smart credential 210 and/or the secure facility 260 or the access system 275. For example, in one embodiment, an input/output device may include a relatively small touchscreen display and/or a keypad for receiving inputs. In various embodiments, an input/output device may have capabilities for directly receiving such signals from the user 215, the smart credential 210 and/or the servers 262 that provides a signal or an instruction to operate one or more of the access systems 275.

In some embodiments, one or more of the access systems 275 may include an electromechanical operating and/or locking mechanism which is designed to automatically open or close the access systems 275, or to lock or unlock the access systems 275, in response to signals or instructions from an authorized device (e.g., the smart credential 210 and/or the servers 262) using a wired or wireless protocol or standard. Such instructions may include a password or another authenticator (e.g., a cryptographic key). Additionally, the access system 275 may include one or more sensors (e.g., imaging devices, digital cameras, motion sensors, heat sensors, weight sensors or the like), and may be configured to capture information or data regarding successful or unsuccessful attempts at operating the access systems 275, or any other events occurring at the secure facility 260.

The computer system 280 may be any type or form of computer device such as a smartphone, a tablet computer, a laptop computer, a desktop computer, or computing devices provided in wristwatches, televisions, set-top boxes, automobiles or any other appliances or machines, or any other like machine. As is shown in FIG. 2A, the computer system 280 may include one or more processors 282, memory components 284 (e.g., databases or data stores), or input/output devices 286 (e.g., keyboards, keypads, mice, styluses, touchscreens, RFID readers, or other devices). In some embodiments, the computer system 280 may be accessed or operated by the user 215, e.g., while the user 215 is wearing, carrying or otherwise bearing the smart credential 210. In some embodiments, the computer system 280 may be accessed by way of a single-factor authentication process, e.g., where the user 215 or another operator enters a user name or password, or otherwise provides authentication information (e.g., biometric data such as a thumb print, an eye scan, or an audible code) to the computer system 280. In such embodiments, a single-factor authentication process may grant access to the computer system 280 following a successful handshake between the smart credential 210 and one or more of the beacons 270-1, 270-2 . . . **270-*n*. In some embodiments, the computer system 280 may be accessed by way of a multi-factor authentication process, e.g., where the user 215 or another operator is authenticated by two or more techniques. In such embodiments, a successful handshake between the smart credential 210 and one or more of the beacons 270-1, 270-2 . . . 270-*n*** may be one factor of a multi-factor authentication process.

The network 290 may be any wired network, wireless network, or combination thereof for enabling communication between the smart credential 210, the secure facility 260 and/or the computer system 280, or any other computer systems or devices. The network 290 may, in some embodiments, include the Internet in whole or in part. For example, in some embodiments, the network 290 may be a personal area network, local area network, wide area network, cable network, satellite network, cellular telephone network, or combination thereof. The network 290 may also be a publicly accessible network of linked networks, possibly operated by various distinct parties, such as the Internet. In some embodiments, the network 290 may be a private or semi-private network, such as a corporate or university intranet. The network 290 may include one or more wireless networks, such as a Global System for Mobile Communications (GSM) network, a Code Division Multiple Access (CDMA) network, a Long Term Evolution (LTE) network, a Wi-Fi network, a Bluetooth® network, or some other type of wireless network, and may include any components for communicating wirelessly according to one or more other protocols or technologies, such as RFID or NFC. Protocols and components for communicating via any of the other aforementioned types of networks are well known to those skilled in the art of computer communications and thus, need not be described in more detail herein. In some embodiments, the network 290 may include one or more routers or transmitters that are configured to generate, transmit and/or receive one or more signals sent by or to the smart credential 210, the secure facility 260 (e.g., the server 262, the beacons 270-1, 270-2 . . . **270-*n*, or the access system 275), or the computer system 280**.

Any combination of networks or communications protocols or standards may be utilized in accordance with the systems and methods of the present disclosure. For example, the smart credential 210, the secure facility 260, the server 262, the beacons 270-1, 270-2 . . . **270-*n*, the access system 275 and/or the computer system 280 may be configured to communicate with one another via the network 290, such as is shown in FIGS. 2A and 2B, e.g., via an open or standard protocol or standard, such as Wi-Fi. Alternatively, the smart credential 210, the secure facility 260, the server 262, the beacons 270-1, 270-2 . . . 270-*n*, the access system 275 and/or the computer system 280 may be configured to communicate with one another directly outside of a centralized network, such as the network 290, e.g., by a wireless protocol or standard, such as Bluetooth, in which one or more of the smart credentials 210, the server 262, the beacons 270-1, 270-2 . . . 270-*n*, the access system 275 or the computer system 280** may but need not be paired with one another.

The smart credential 210, the secure facility 260, the server 262, the beacons 270-1, 270-2 . . . **270-*n*, the access system 275 and/or the computer system 280 may use any applications, features, or messaging techniques to connect to the network 290 or to communicate with one another. For example, the smart credential 210, the secure facility 260, the server 262, the beacons 270-1, 270-2 . . . 270-*n*, the access system 275 and/or the computer system 280 may be adapted to transmit information or data in the form of synchronous or asynchronous messages between or among themselves, or between or among any other computer device in real time or in near-real time, or in one or more offline processes, via the network 290. The protocols and components for providing communication between such devices are well known to those skilled in the art of computer communications and need not be described in more detail herein. Moreover, the data and/or computer executable instructions, programs, firmware, software and the like (also referred to herein as "computer executable" components) described herein may be stored on a computer-readable medium that is within or accessible by computers or computer components such as the smart credential 210, the secure facility 260, the server 262, the beacons 270-1, 270-2 . . . 270-*n*, the access system 275 and/or the computer system 280, or any other computers or control systems utilized by the user 215 or the secure facility 260**, and having sequences of instructions which, when executed by a processor (e.g., a central processing unit, or "CPU"), cause the processor to perform all or a portion of the functions, services and/or methods described herein. Such computer executable instructions, programs, software and the like may be loaded into the memory of one or more computers using a drive mechanism associated with the computer readable medium, such as a floppy drive, CD-ROM drive, DVD-ROM drive, network interface, or the like, or via external connections.

The present disclosure references a number of computer-based functions or tasks that may be executed by one or more computer processors, systems or resources. In some implementations, each of such functions or tasks may be executed by processors associated with a smart credential, a secure facility or a computer system, and one or more of the smart credential 210 and/or the server 262, the beacons 270-1, 270-2 . . . **270-*n*, the access system 275 and/or the computer system 280 may independently act upon instructions generated by such processors upon executing such functions or tasks. In some other implementations, each of such functions or tasks may be executed by processors that are external to the smart credential 210, the secure facility 260 or the computer system 280, such as in one or more other physical, alternate or virtual locations, e.g., in a "cloud"-based environment. In still other implementations, such functions or tasks may be executed in a distributed manner, such as by computer processors, systems or resources in two or more distributed locations. For example, some of such functions or tasks may be executed by processors associated with one or more smart credentials or beacons in or within a vicinity of the secure facility 260**, while other functions or tasks may be executed by processors located in one or more other physical, alternate or virtual locations, e.g., in a "cloud"-based environment.

Figure 3A:
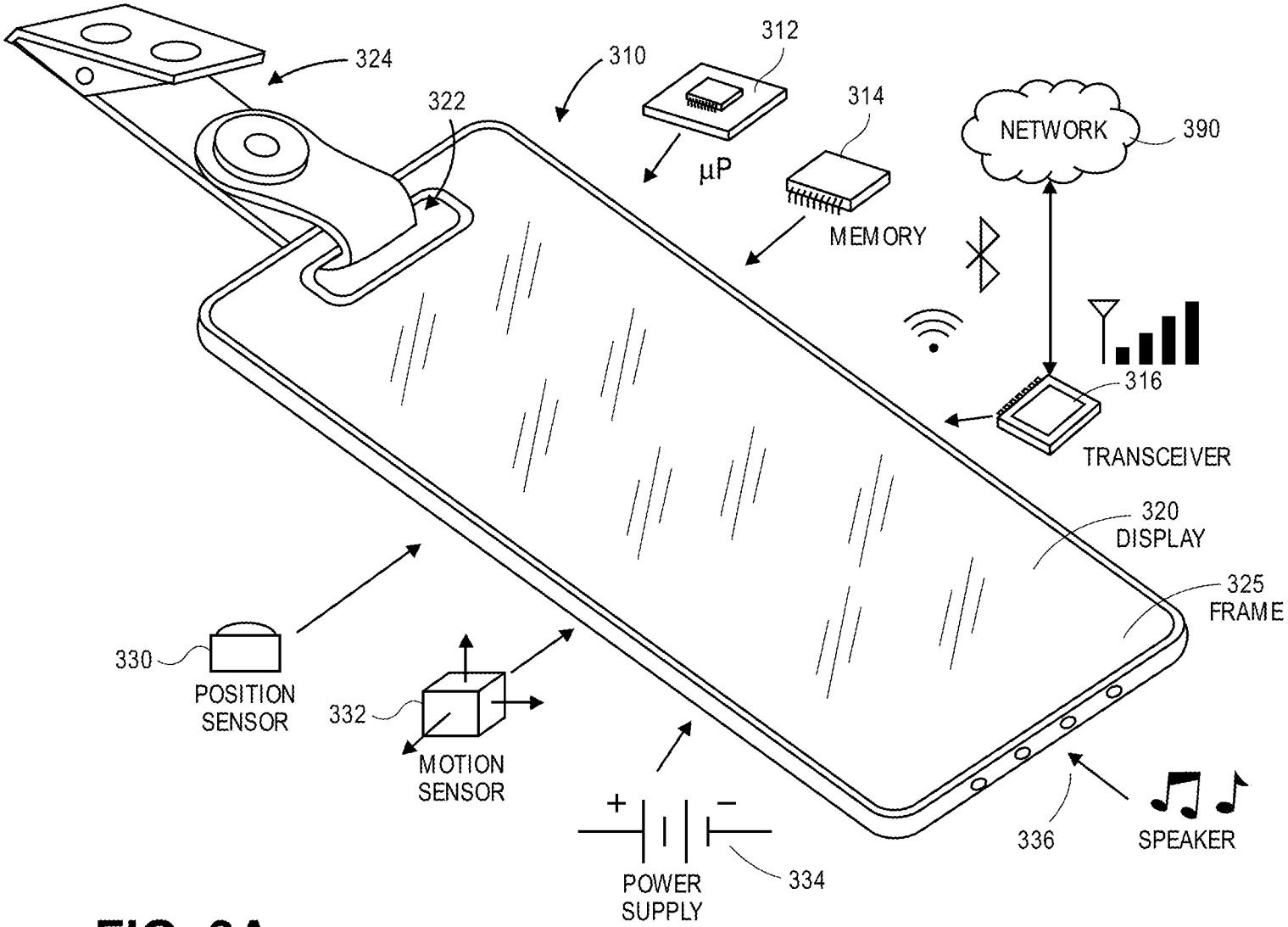
FIGS. 3A and 3B are views of one smart credential in accordance with embodiments of the present disclosure.
Figure 3B:
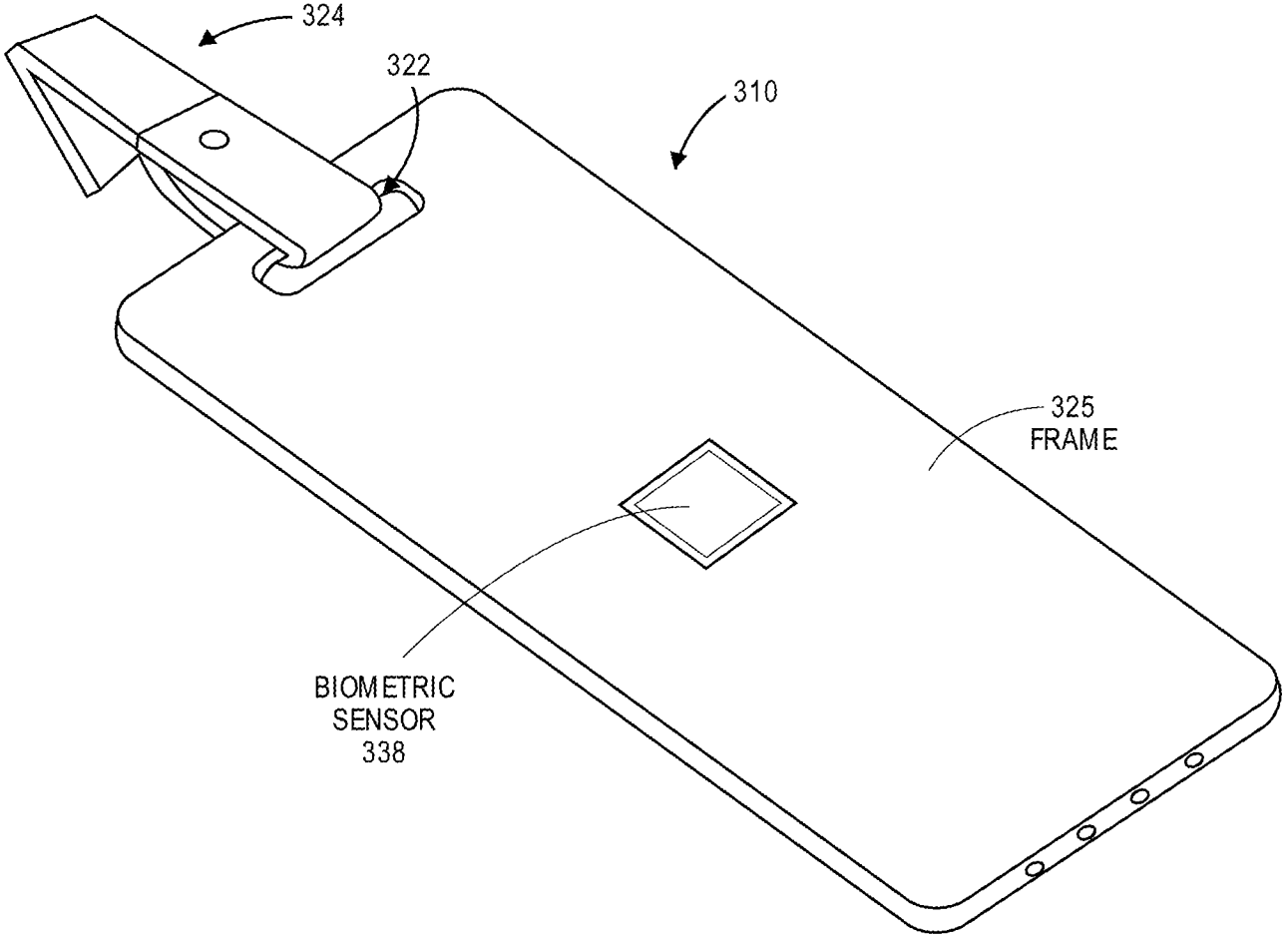

Referring to FIGS. 3A and 3B, a view of one smart credential in accordance with embodiments of the present disclosure is shown. Except where otherwise noted, reference numerals preceded by the number "3" in FIGS. 3A and 3B refer to elements that are similar to elements having reference numerals preceded by the number "2" in FIG. 2A or FIG. 2B, or by the number "1" shown in FIGS. 1A through 1F. FIG. 3A shows a front side or face of a smart credential 310. FIG. 3B shows a rear side or face of the smart credential 310.

As is shown in FIGS. 3A and 3B, the smart credential 310 includes a display 320 and a frame 325. The display 320 may be an electronic ink display, an LCD display, an LED display, an OLED display, or any other form of display that is configured to display context-specific information regarding the credential 310 or a user thereof. In some embodiments, the display 320 may be a touchscreen display, e.g., a capacitive touchscreen. The frame 325 may be any housing or other structure formed in any manner, e.g., by injection molding, rotational molding, extrusion molding, vacuum casting, thermoforming, compression molding or the like, of any type of materials. In some embodiments, the frame 325 may be formed from plastics (e.g., thermosetting plastics, resins, polyurethanes, polyesters, polyethylenes, polypropylenes or polyvinyl chlorides), metals (e.g., aluminum or aluminum alloys, steel or steel alloys, or others), wood, composites or any other combinations of materials.

As is also shown in FIGS. 3A and 3B, the frame 325 includes an opening (or slot) 322 through which a clip attachment 324 is inserted.

The frame 325 includes the display 320 and a number of other components therein, including but not limited to a processor 312, a memory component 314, a transceiver 316, a position sensor 330, a motion sensor 332, a power supply 334, a speaker 336 (or other feedback device) and a biometric sensor 338.

The processor 312 and/or the memory component 314 may be in communication with one or more of the other components within the frame 325, and may control one or more aspects of their respective operations. The transceiver 316 is configured to communicate with one or more beacons (not shown) or other computer systems over one or more networks 390, e.g., by Wi-Fi, Bluetooth®, RFID or NFC technologies.

Although FIG. 3B shows that one or more components of the biometric sensor 338 (e.g., an input sensor) are provided on a rear side or face of the smart credential 310, those of ordinary skill in the pertinent arts will recognize that biometric sensors 338 may be provided in any location, e.g. on any side or face, of the smart credential 310 in accordance with some embodiments of the present disclosure. For example, in some embodiments, the biometric sensor 338 may be provided in association with, or integral to, the display 320.

Figure 4:
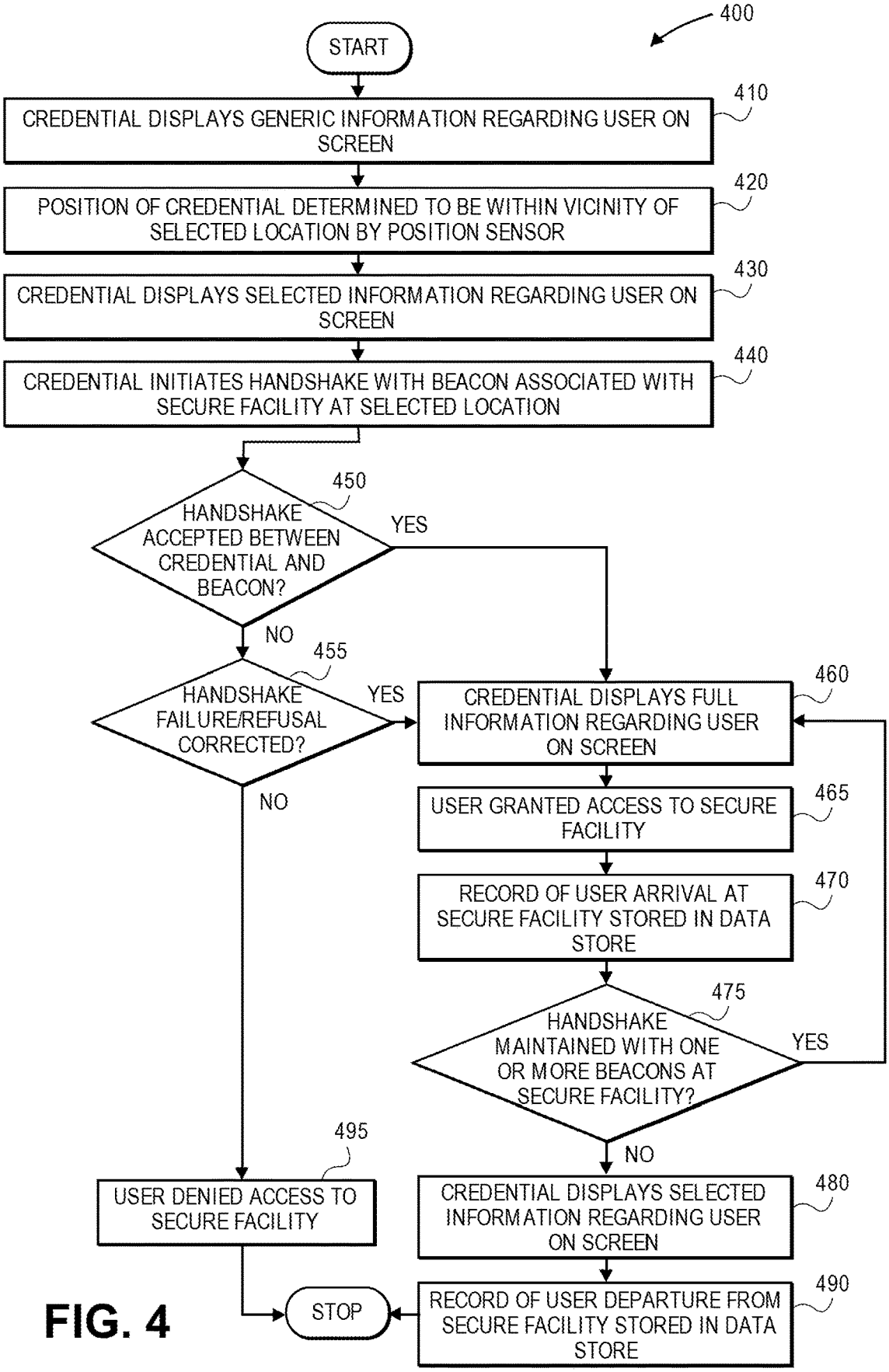
FIG. 4 is a flow chart of one process for using smart credentials in accordance with embodiments of the present disclosure.

The smart credentials of the present disclosure may be utilized to display relevant information regarding a user where and when the information is required, and not at times or in locations where the information is not required, thereby reducing a level of risk that the user's personal information may be collected or used by others in a surreptitious manner, and enhancing a level of security at secure facilities where the personal information is required. Referring to FIG. 4, a flow chart 400 of one process for using smart credentials in accordance with embodiments of the present disclosure is shown. At box 410, a smart credential displays generic information regarding a user on a screen. For example, the generic information may include a select subset of the information that is available regarding a user, such as a first name (e.g., a nickname) of the user, an image of the user, or any other information. Alternatively, the generic information may include information regarding an organization or a facility with which the smart credential is associated, e.g., a business, a hospital, an educational institution, or others. The information may be stored in one or more memory components thereon or received, e.g., over a network, by one or more transceivers.

At box 420, a position of the smart credential is determined to be within a vicinity of the selected location, e.g., based on information or data received by one or more position sensors, and at box 430, the smart credential displays selected information regarding the user on the screen. For example, referring again to FIG. 1C, the additional information 125-2 includes more information than simply a first name of the user 115, and also a trademark associated with the building 160, but does not include any additional personal or confidential information, such as an electronic mail address or alias, a telephone number, an employer identification number, or the like.

At box 440, the smart credential initiates a handshake with a beacon associated with a secure facility at the selected location. For example, the smart credential may transmit one or more synchronization packets to the beacon over one or more networks and according to any protocol or standard. In some embodiments, the smart credential may be programmed with locations of one or more beacons and, upon determining that the smart credential is within a vicinity of a location of a specific beacon, initiate a handshaking procedure by generating and transmitting synchronization packets to the beacon. Alternatively, in some other embodiments, the beacon may initiate a handshaking procedure with the smart credential, e.g., by generating and transmitting synchronization packets to the smart credential. At box 450, whether the handshake is accepted between the smart credential and the beacon is determined. For example, whether a synchronization acknowledgment is received in response to a synchronization packet transmitted by the smart credential to the beacon, or by the beacon to the smart credential, and whether an acknowledgment to the synchronization acknowledgement is transmitted received in response, thereby opening a communications channel between the smart credential and the beacon, may be determined.

If the smart credential fails or is refused, then the process advances to box 455, where whether the failure or refusal is corrected may be determined. For example, referring again to FIG. 1E, where an attempted handshake between the smart credential 110 and the first beacon 170-1 is not successfully completed, one or more of the security guards 174-1, 174-2 or other personnel may determine that the user 115 is authorized to enter the secure area 165 via the access point 172. Alternatively, the smart credential and the beacon may attempt another handshake. If the failure or refusal is not corrected, then the process advances to box 495, where the user is denied access to the secure facility, and the process ends.

If the handshake is accepted, or after the failure or refusal is corrected, then the process advances to box 460, where the smart credential displays full information regarding the user on the screen. For example, the smart credential may display an image, a name, an electronic mail address or alias, or other contact information of the user, as well as a location of an office, a laboratory, a workspace or other area associated with the user within the secure facility. At box 465, the user is granted access to the secure facility, e.g., by the manual or automatic operation of one or more access control systems, or in any other manner. At box 470, a record of an arrival of the user at the secure facility is stored in one or more data stores. For example, the record may indicate a time and/or a date of the handshake, as well as a geolocation or other identifier of the beacon, or any other data regarding the arrival of the user at the secure facility. Moreover, the record may be provided to, shared with or accessed by one or more scheduling systems, calendar systems or access control systems, or any other systems or applications.

At box 475, whether a handshake is maintained between the smart credential and one or more beacons at the secure facility is determined. For example, the smart credential may be within an operating range of one or more of the beacons, and may successfully complete handshakes with any number of such beacons. If at least one handshake is maintained with one or more of the beacons, then the process returns to box 460, and the full information regarding the user remains on the screen of the smart credential. If at least one handshake is not maintained with one or more of the beacons, however, then the process advances to box 480, where the smart credential displays the selected information regarding the user on the screen. For example, where the smart credential is no longer maintaining a handshake with any of the beacons, the smart credential may infer that it is no longer within the secure facility, and may remove any personal information from the smart credential that is only relevant or required within the secure facility from the screen, or display other information on the screen. At box 490, a record of a departure of the user from the secure facility, e.g., indicating a time and/or a date of a latest handshake or a departure, as well as a geolocation or other identifier of a beacon with which the smart credential completed the latest handshake, or any other data regarding the departure of the user from the secure facility, is stored in one or more data stores, and the process ends.

Figure 5A:
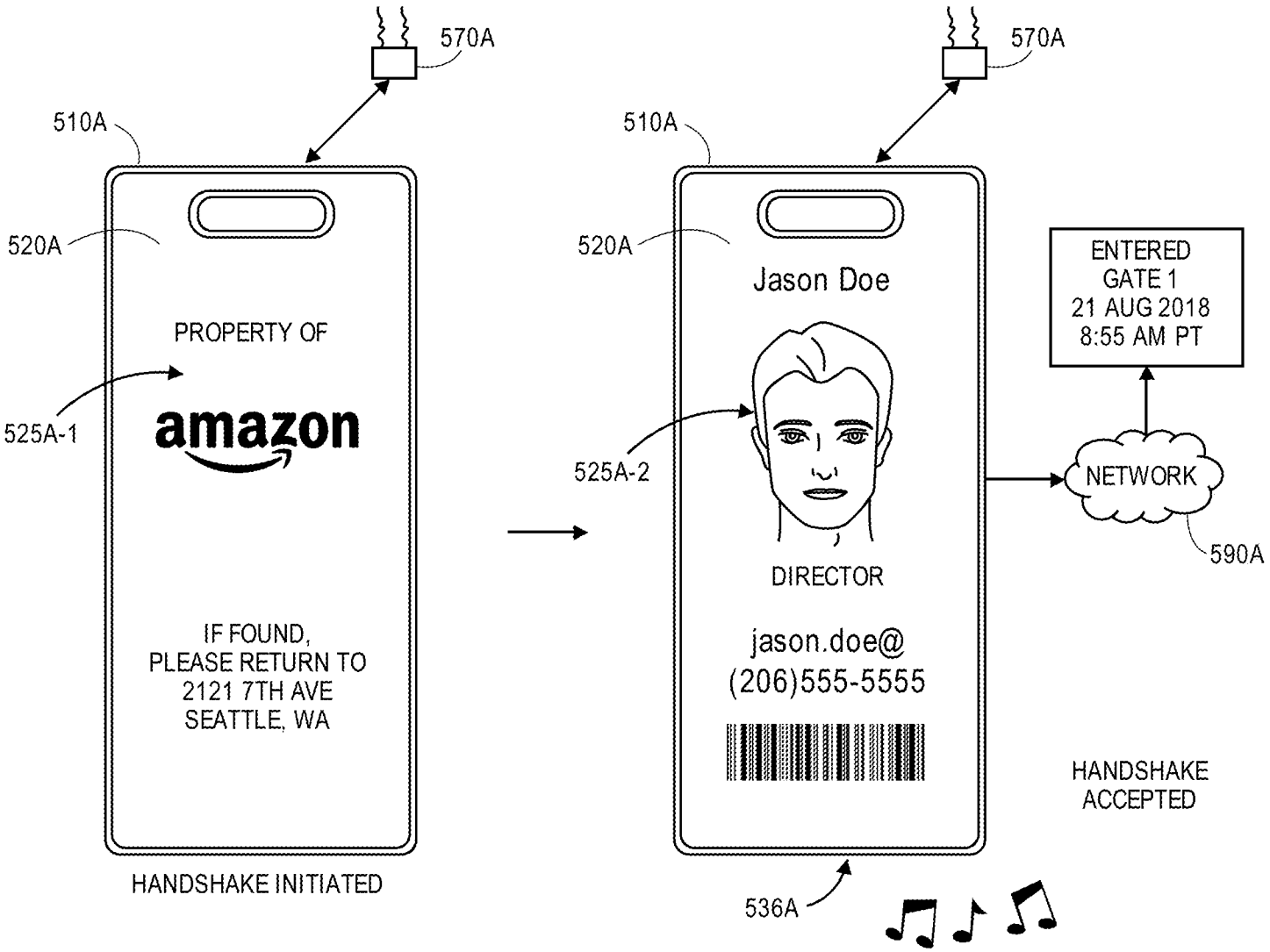
FIGS. 5A, 5B and 5C are views of smart credentials and information or data presented thereon, in accordance with embodiments of the present disclosure.
Figure 5B:
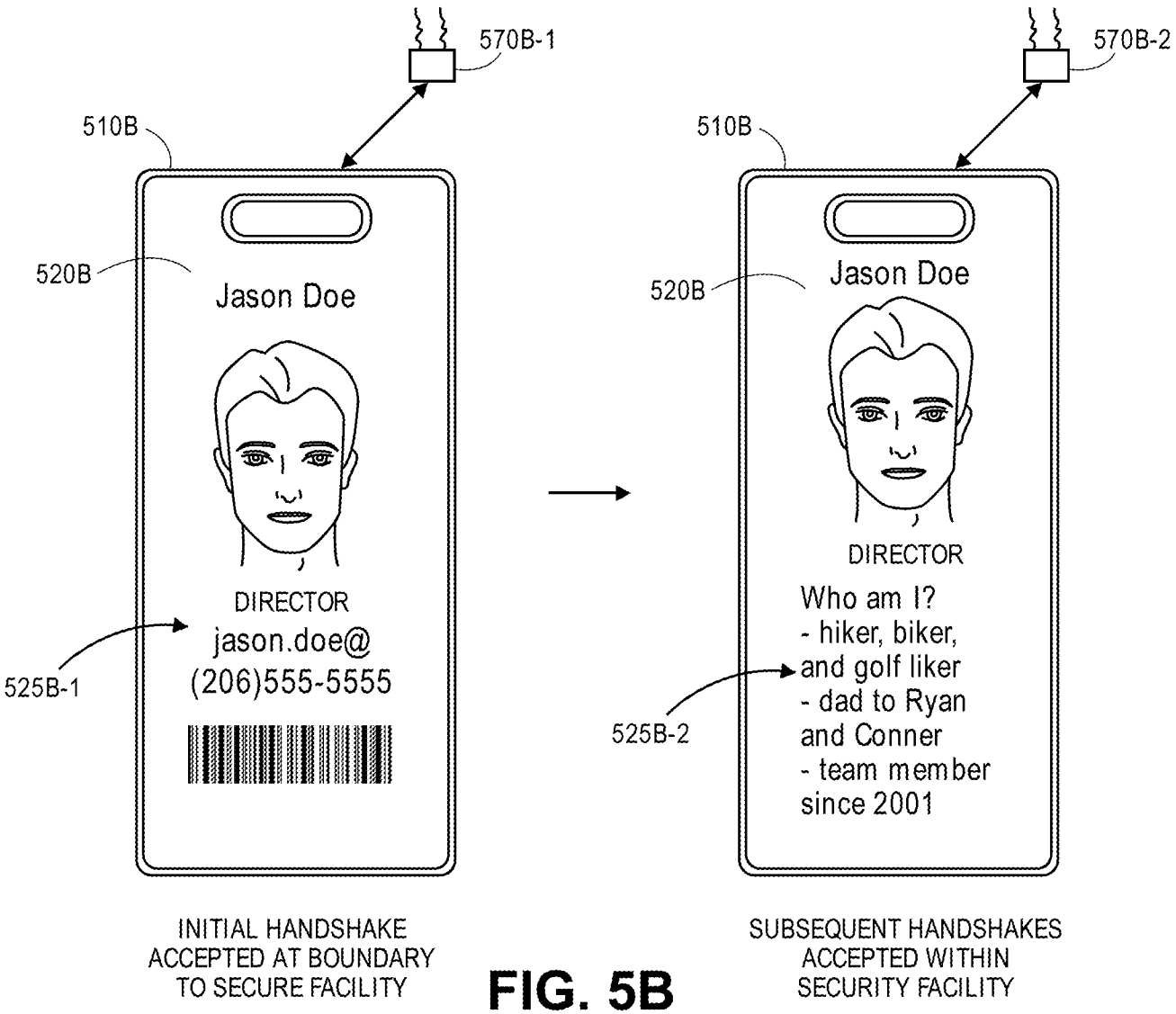
Figure 5C:
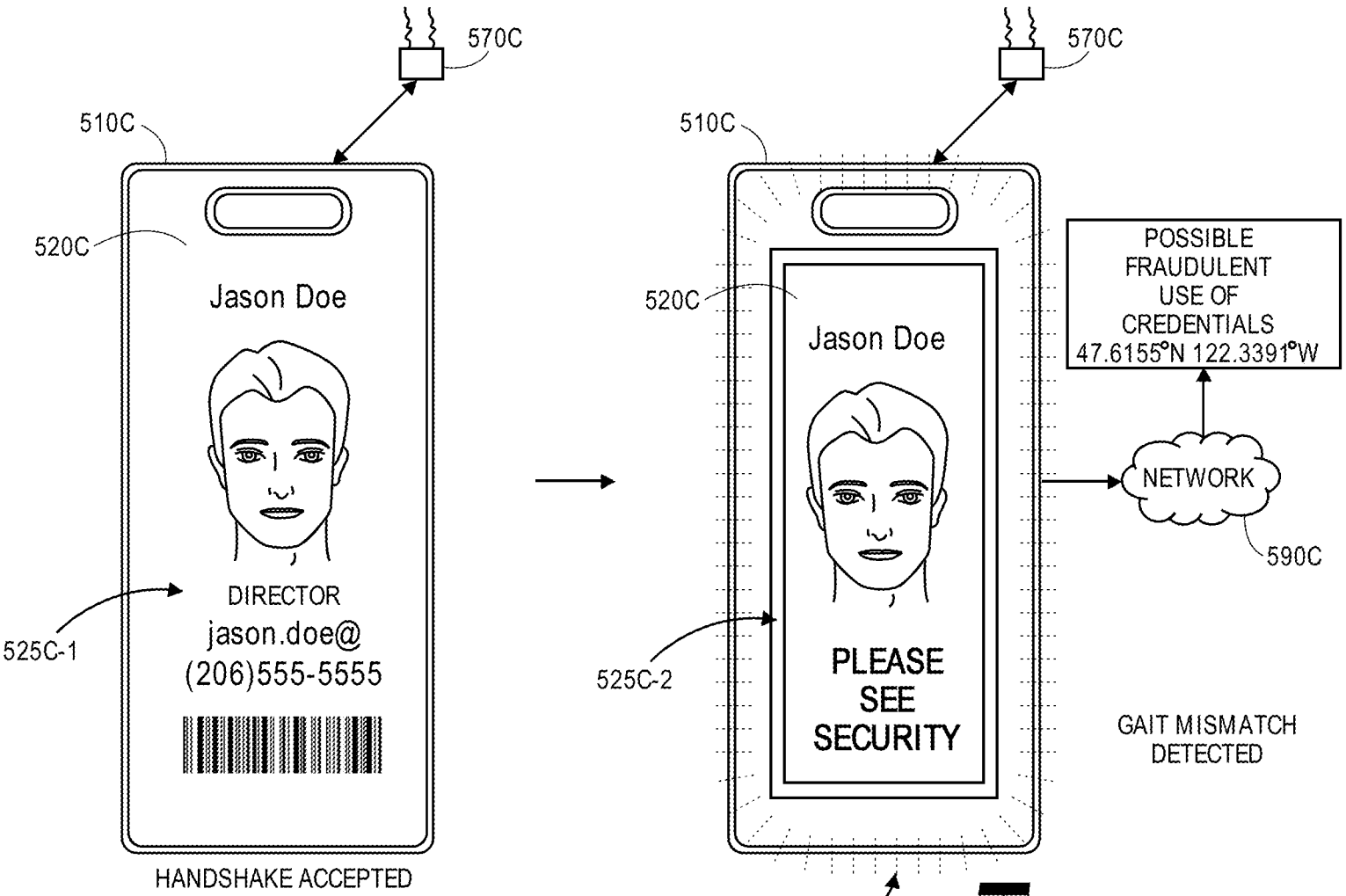

As is discussed above, the information that may be displayed on a smart credential may be selected on any basis. Referring to FIGS. 5A, 5B and 5C, views of smart credentials and information or data presented thereon, in accordance with embodiments of the present disclosure are shown. Except where otherwise noted, reference numerals preceded by the number "5" in FIGS. 5A, 5B and 5C refer to elements that are similar to elements having reference numerals preceded by the number "3" in FIGS. 3A and 3B, by the number "2" in FIG. 2A or FIG. 2B, or by the number "1" shown in FIGS. 1A through 1F.

As is shown in FIG. 5A, a smart credential 510A including a display 520A initiates a handshake with a beacon 570A, e.g., by exchanging synchronization and/or acknowledgement packets of information or data with the beacon 570A. At a time when the handshake is initiated, the display 520A includes a first set of context-specific information 525A-1 regarding an organization with which the smart credential 510A or an authorized user thereof is associated. For example, as is shown in FIG. 5A, the context-specific information 525A-1 includes an indication that the smart credential 510A is the property of the organization, as well as a trademark associated with the organization, along with instructions for returning the smart credential 510A to an address or location associated with the organization if the smart credential 510A is found.

Once the handshake is accepted, a second set of context-specific information 525A-2 is shown on the display 520A. The context-specific information 525A-2 includes a name of an authorized user of the smart credential 510A, an image of the authorized user of the smart credential 510A, a title of the authorized user of the smart credential 510A, an electronic mail address or alias of the authorized user of the smart credential 510A, and a telephone number of the authorized user of the smart credential 510A, as well as an optically readable bar code that may be linked with any additional information regarding the authorized user of the smart credential 510A. Additionally, and as is also shown in FIG. 5A, once the handshake is accepted, the smart credential 510A may generate one or more sounds, e.g., by the speaker 536A. Alternatively, the smart credential 510A may cause a display of one or more lights or signals on the display 520A, or vibrate at one or more selected frequencies.

As is also shown in FIG. 5A, the smart credential 510A may generate and transmit one or more messages indicating a date and a time at which the smart credential 510A passed through a selected access point to a secure facility to a server over a network 590A. Subsequently, when the smart credential 510A is not engaged in any further handshakes, the smart credential 510A, may further display the first set of context-specific information 525A-1 (or any other relevant information) on the display 520A, or generate feedback. The smart credential 510A may also generate and transmit one or more additional messages indicating a date and a time at which the smart credential 510A departed the secure facility through a selected access point.

As is shown in FIG. 5B, a smart credential 510B including a display 520B is shown after an initial handshake with a first beacon 570B-1 has been accepted. After the initial handshake is accepted, the display 520B includes a first set of context-specific information 525B-1, viz., a name of the authorized user of the smart credential 510B, an image of the authorized user of the smart credential 510B, a title of the authorized user of the smart credential 510B, an electronic mail address or alias of the authorized user of the smart credential 510B, and a telephone number of the authorized user of the smart credential 510B, as well as an optically readable bar code that may be linked with any additional information regarding the authorized user of the smart credential 510B. For example, the first beacon 570B-1 may be associated with a boundary (e.g., an access point and/or an access system) to access a secure facility.

After completing a handshake with the first beacon 570B-1 at a boundary to the secure facility, the smart credential 510B may execute one or more subsequent handshakes with a second beacon 570B-2 within the secure facility. Once the one or more subsequent handshakes are accepted, a second set of context-specific information 525B-2 is shown on the display 520B. As is shown in FIG. 5B, the context-specific information 525B-2 includes the name of the authorized user of the smart credential 510B, an image of the authorized user of the smart credential 510B, and a title of the authorized user of the smart credential 510B. The context-specific information 525B-2 further includes additional personal information regarding the authorized user of the smart credential 510B, e.g., hobbies of the authorized user of the smart credential 510B, names of family members of the authorized user of the smart credential 510B, or information regarding a level of experience of the authorized user of the smart credential 510B. In some embodiments, the acceptance of either the initial handshake or one or more subsequent handshakes may be accompanied by feedback to the user.

As is shown in FIG. 5C, a smart credential 510C including a display 520C is shown after an initial handshake with a beacon 570C has been accepted. After the initial handshake is accepted, the display 520C includes a first set of context-specific information 525C-1, viz., a name of the authorized user of the smart credential 510C, an image of the authorized user of the smart credential 510C, a title of the authorized user of the smart credential 510C, an electronic mail address or alias of the authorized user of the smart credential 510C, and a telephone number of the authorized user of the smart credential 510C, as well as an optically readable bar code that may be linked with any additional information regarding the authorized user of the smart credential 510C.

When a bearer of the smart credential 510C has worn, carried or otherwise transported the smart credential 510C throughout a given location, e.g., a secure facility, one or more motion sensors provided within the smart credential 510C may capture information or data regarding accelerations, velocities or positions of the smart credential 510C, e.g., linear or rotational motion of the smart credential along or about one or more axes (viz., x-, y- or z-axes). A signature of a gait of the bearer may be generated and compared to a previously generated signature of a gait of the authorized user of the smart credential 510C, which may be stored in association with other information regarding the authorized user of the smart credential 510C. Where the smart credential 510C determines that the signature of the gait of the bearer differs substantially from the signature of the gait of the authorized user of the smart credential 510C, e.g., by calculating a confidence score or other metric representative of similarities or differences between the respective signatures and comparing the confidence score to a threshold, the smart credential 510C may generate feedback in the form of one or more signals, such as by displaying words, flashing lights or symbols on the display 520C, or by playing specific sounds from a speaker 536C. For example, as is shown in FIG. 5C, the smart credential 510C may display a second set of context-specific information 525C-2 indicating that the bearer or others that the bearer must contact one or more security personnel to resolve the discrepancy. Additionally, the smart credential 510C may transmit one or more messages indicating that the bearer of the smart credential 510C may not be the authorized user of the smart credential 510C, or that the use of the smart credential 510C may not be authorized, to a server over a network 590C. Such messages may include any relevant information regarding the smart credential 510C, e.g., a location of the smart credential 510C, at a time when the signature of the gait of the bearer of the smart credential 510C is determined to be different from the signature of the gait of the authorized user of the smart credential 510C.

Figure 6:
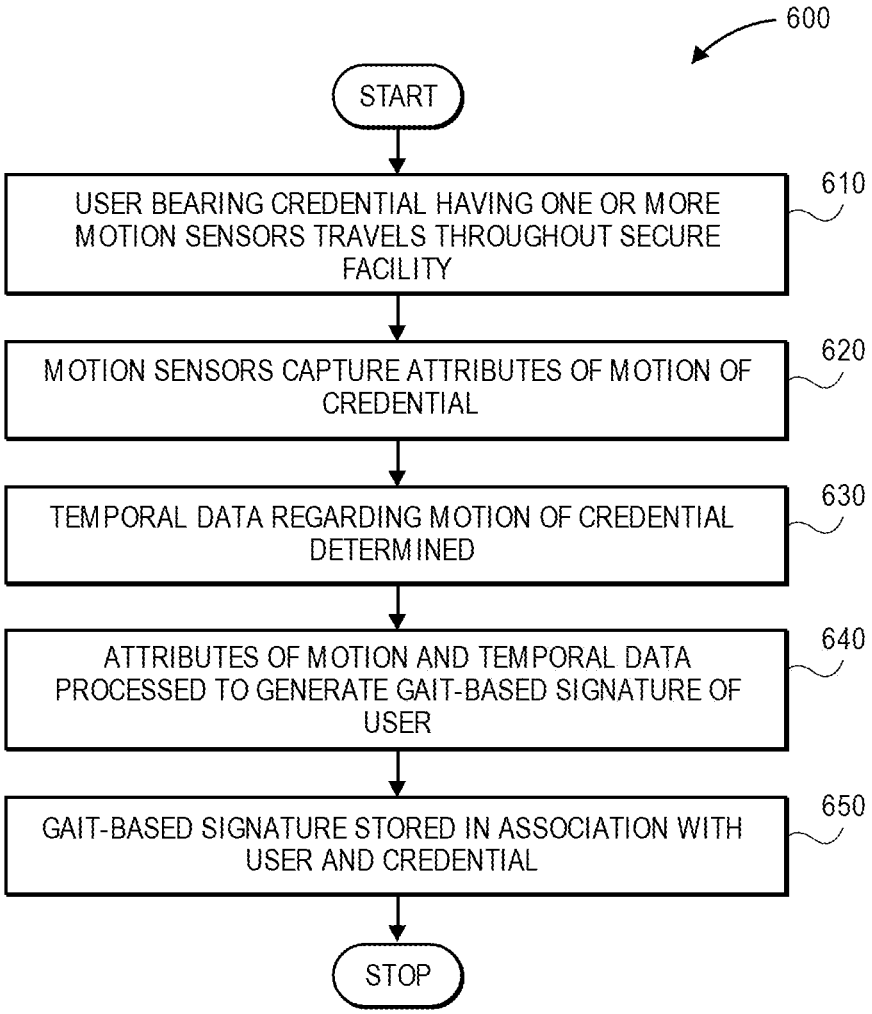
FIG. 6 is a flow chart of one process for using smart credentials in accordance with embodiments of the present disclosure.

As is discussed above, a smart credential may be configured to capture information or data regarding a gait of a user, and to generate a gait signature based on such information or data that may be stored in association with other information or data regarding the user. Referring to FIG. 6, a flow chart 600 of one process for using smart credentials in accordance with embodiments of the present disclosure is shown. At box 610, a user bearing a smart credential having one or more motion sensors travels throughout a secure facility, and at box 620, the motion sensors capture one or more attributes of the motion of the smart credential, e.g., accelerations, velocities or positions of the smart credential, including but not limited to both linear and rotational accelerations or velocities. For example, the smart credential may include one or more accelerometers, gyroscopes, compasses or other sensors for measuring a variety of data relating to accelerations, velocities, positions, inclinations, or the like, e.g., along a single axis, or in multiple directions or along multiple axes (viz., x-, y- or z-axes), and generate outputs accordingly in the form of scalars or vectors.

At box 630, temporal data regarding the motion of the smart credential is determined. For example, the temporal data may include time-stamps of handshakes with one or more beacons, or time-stamps of measured or sensed values of accelerations, velocities or positions. At box 640, attributes of the motion and the temporal data are processed to generate a gait-based signature for the user. For example, in some embodiments, the signature may be generated on periodic vertical accelerations of the smart credential, or vertical displacements or other changes in position of the smart credential, as the user walks through the secure facility. Alternatively, the attributes of motion of the smart credential and the temporal data may be provided to one or more trained machine learning system as inputs, and the gait-based signature of the user may be generated based on an output received from the trained machine learning system as outputs. A gait-based signature may be generated in any manner in accordance with the present disclosure, and using any algorithm, system or technique.

At box 650, the gait-based signature generated at box 640 is stored in association with the user, and the process ends. For example, the gait-based signature may be stored in one or more memory components on the smart credential, in one or more data stores maintained in the same physical location as the secure facility, or in one or more alternate or virtual locations, e.g., in a "cloud"-based environment.

In some embodiments, the attributes of the motion of the smart credential and the temporal data may be processed using one or more processors of the smart credential. In some other embodiments, however, the smart credential may transmit the attributes of the motion and the temporal data to one or more external computer systems, where the attributes of the motion and the temporal data may be processed to generate the gait-based signature. The gait-based signature may then be stored in one or more memory components on the smart credential, in one or more data stores at the secure facility, or in one or more alternate or virtual locations, e.g., in a "cloud"-based environment. Additionally, in some embodiments, the gait-based signature may be calculated based on attributes of motion of the smart credential and the user in any location, and need not be calculated based exclusively on attributes of the motion of the smart credential and the user within the secure facility.

Figure 7A:
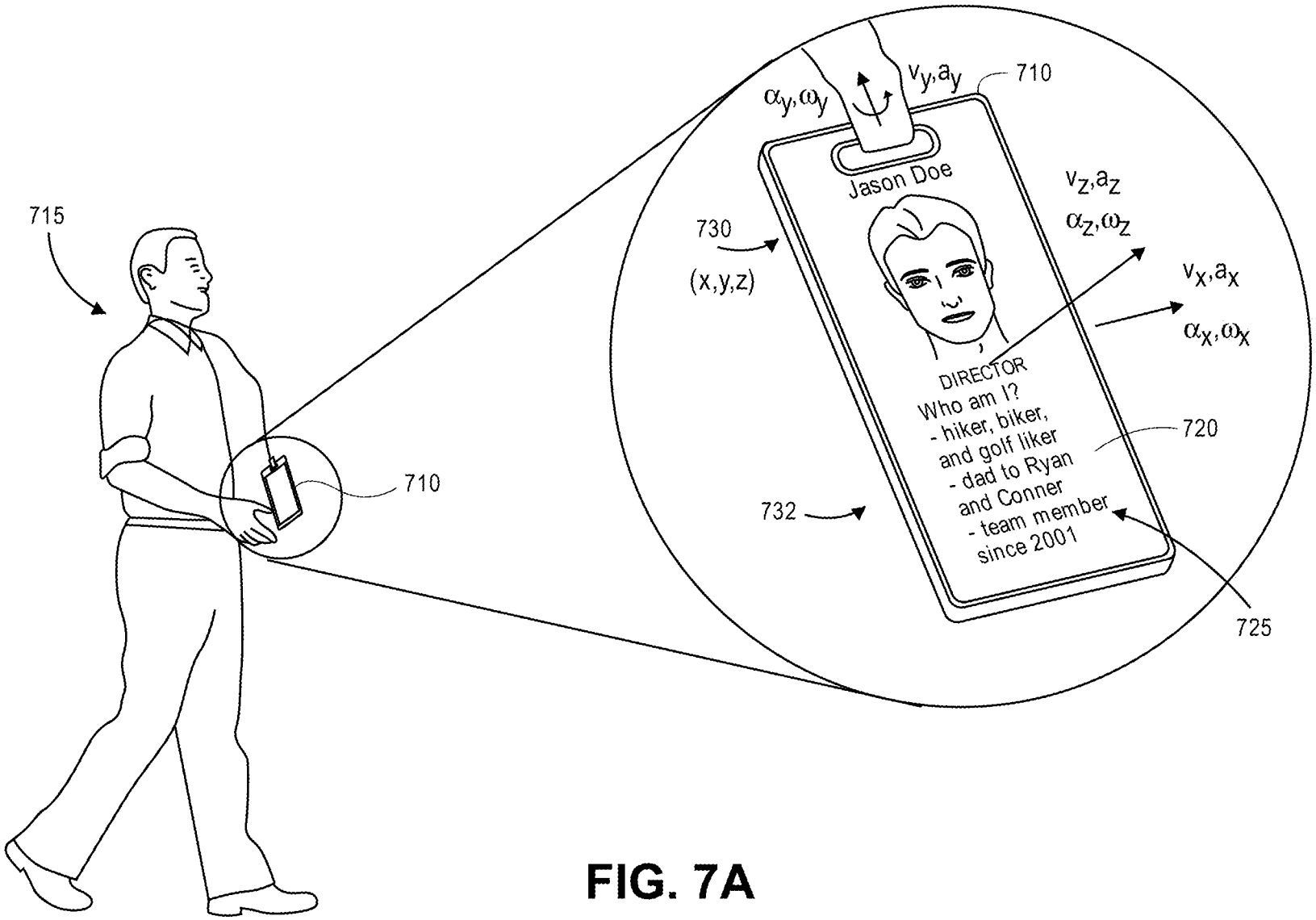
FIGS. 7A and 7B views of one system for using smart credentials in accordance with embodiments of the present disclosure.
Figure 7B:
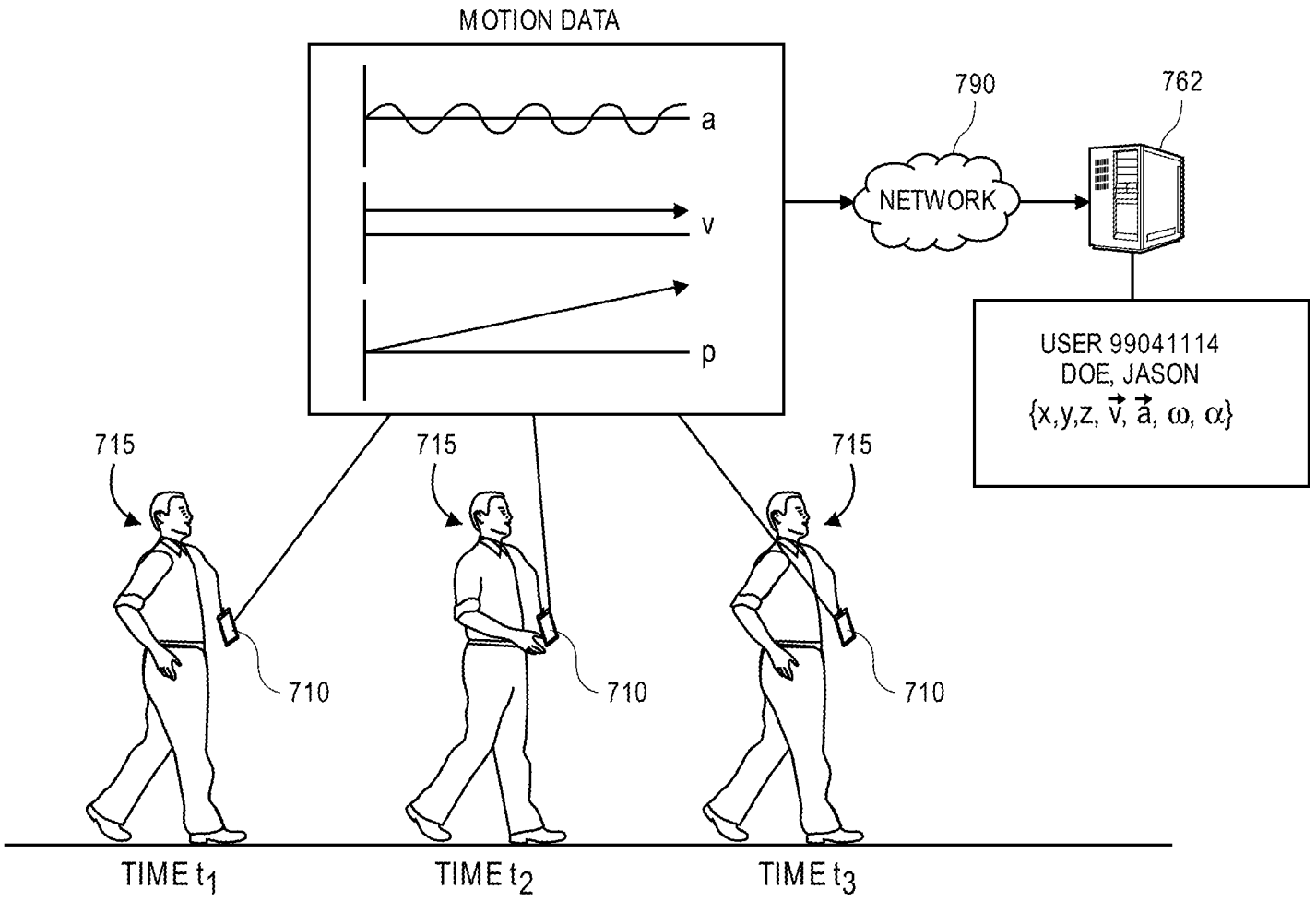

Referring to FIGS. 7A and 7B, views of one system for using smart credentials in accordance with embodiments of the present disclosure are shown. Except where otherwise noted, reference numerals preceded by the number "7" in FIGS. 7A and 7B refer to elements that are similar to elements having reference numerals preceded by the number "5" in FIGS. 5A, 5B and 5C, by the number "3" in FIGS. 3A and 3B, by the number "2" in FIG. 2A or FIG. 2B, or by the number "1" shown in FIGS. 1A through 1F.

As is shown in FIG. 7A, a smart credential 710 is worn or carried by a user 715. The smart credential 710 includes a display 720 having information 725 regarding the user 715 or a context in which the credential 710 is utilized shown thereon, as well as one or more position sensors 730 or motion sensors 732 disposed therein. The information 725 may have any relation to the user 715, or one or more tasks or functions being performed by the user 715. For example, as is shown in FIG. 7A, the information 725 includes a name of an authorized user of the smart credential 710, an image of the authorized user of the smart credential 710, a title of the authorized user of the smart credential 710, and any additional personal information regarding the authorized user of the smart credential 710, e.g., hobbies of the authorized user of the smart credential 710, names of family members of the authorized user of the smart credential 710, or information regarding a level of experience of the authorized user of the smart credential 710.

The position sensors 730 or motion sensors 732 may be programmed or configured to determine any attributes of the location or the motion of the smart credential 710. For example, position sensors 730 or motion sensors 732 may include one or more accelerometers for determining variations in acceleration in x-, y- or z-directions or along x-, y- or z-axes as a bearer of the smart credential 710 performs one or more tasks or functions in a specific area. The position sensors 730 or motion sensors 732 may further include one or more gyroscopes for determining orientations of the accelerometer about the x-, y- or z-axes during the performance of the tasks or functions. The position sensors 730 or motion sensors 732 may further include one or more compasses for determining directions associated with motion of the smart credential 710 during the performance of the tasks or functions.

As is shown in FIG. 7B, information or data regarding the motion of the smart credential 710 may be gathered over time and used to generate a gait signature of the user 715. In some embodiments, the gait signature may take the form of a vector representing positions and motion of the user 715 over surfaces on foot, e.g., patterns of motion of the user 715, as determined by the smart credential 710, along or about one or more axes. For example, the vector may include one or more functions representative of linear or rotational motion of joints, limbs or other body parts of the user 715 in three-dimensional space. The gait signature may be transmitted over one or more networks 790 to a server 762 and stored in association with information regarding the user 715. Alternatively, the information or data captured by the motion sensor 734 may be transmitted over the one or more networks 790 to the server 762, and the gait signature may be generated by the server 762 and stored thereon.

Figure 8A:
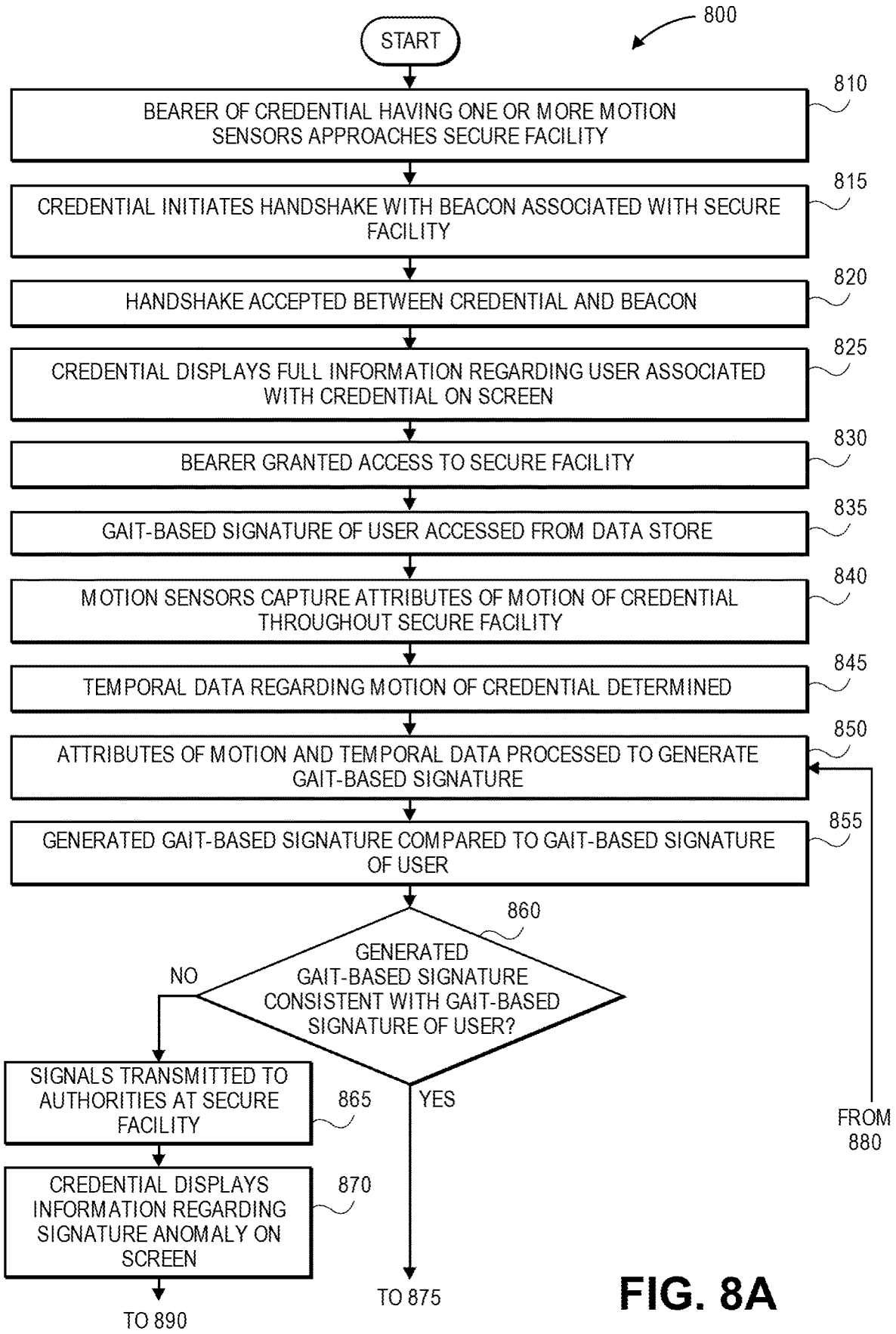
FIGS. 8A and 8B are a flow chart of one process for using smart credentials in accordance with embodiments of the present disclosure.
Figure 8B:
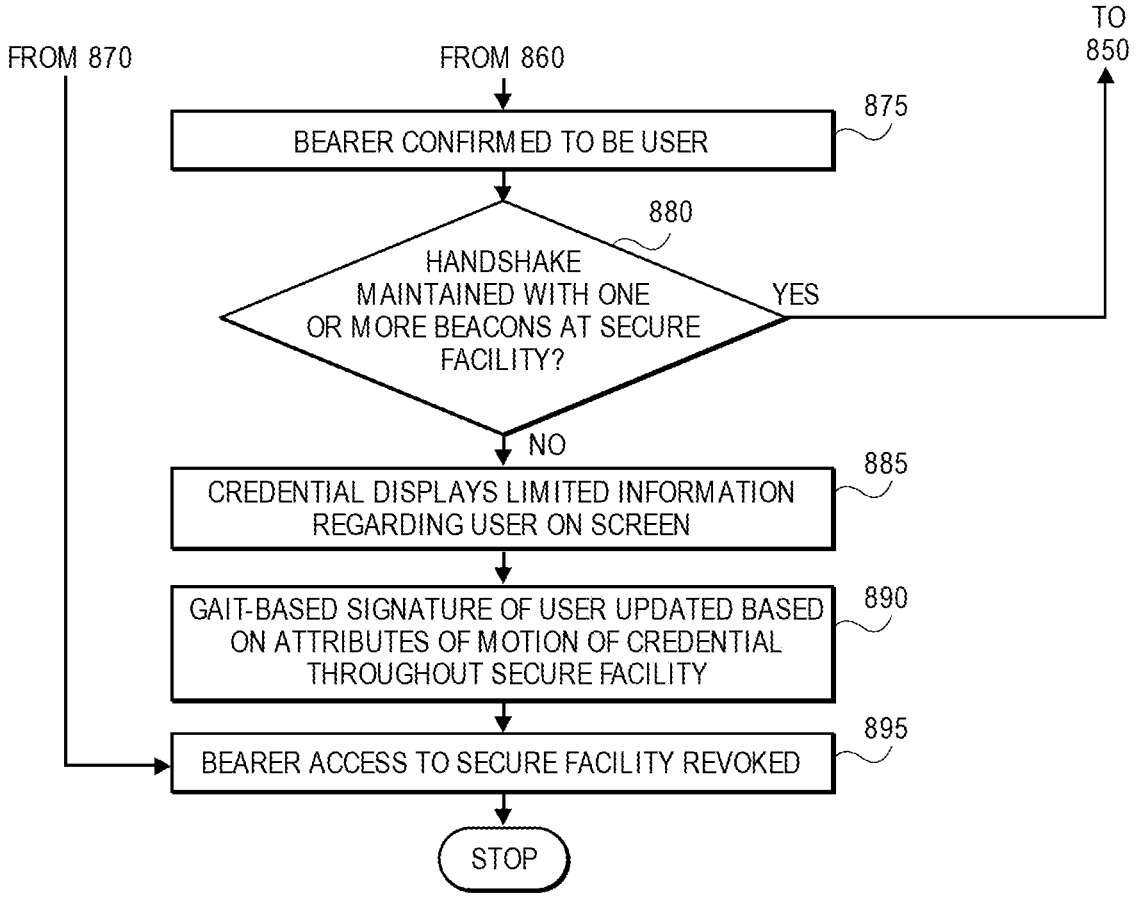

Referring to FIGS. 8A and 8B, a flow chart 800 of one process for using smart credentials in accordance with embodiments of the present disclosure is shown. At box 810, a bearer of a smart credential having one or more motion sensors approaches a secure facility. The smart credential may include a frame, a display and one or more accelerometers, gyroscopes, compasses or other sensors disposed within the frame. At box 815, the smart credential initiates a handshake with a beacon associated with the secure facility, e.g., by transmitting one or more synchronization packets of information or data to the beacon, or by receiving one or more synchronization packets of information or data from the beacon. At box 820, the handshake is accepted between the smart credential and the beacon. For example, upon receiving the synchronization packets, one of the beacon or the smart credential may transmit a synchronization acknowledgement packet in response, and an acknowledgement packet may be transmitted in reply to the synchronization acknowledgement packet.

At box 825, after the handshake has been accepted between the smart credential and the beacon, the process advances to box 825, where the smart credential displays full information regarding a user associated with the smart credential on a screen, and to box 830, where the bearer of the smart credential is granted access to the secure facility. The information displayed on the smart credential may include any or all available information regarding the user, including but not limited to any information relating to one or more tasks or functions to be performed by the user within the secure facility, e.g., a name of the user, a title of the user, contact information for the user, a location such as an office or a laboratory within the secure facility where the user may be expected to attend, or any other information.

At box 835, a gait-based signature of the user is accessed from one or more data stores. The gait-based signature may have been previously generated for or on behalf of the user by any procedure, such as the process shown in the flow chart 600 of FIG. 6, and stored on the smart credential, or in one or more other data stores external to the smart credential.

At box 840, motion sensors of the smart credential capture one or more attributes of motion of the smart credential throughout the secure facility. For example, the one or more accelerometers, gyroscopes, compasses or other sensors disposed within the frame of the smart credential may capture and interpret data regarding linear or rotational motion of the smart credential along or about one or more axes. At box 845, temporal data regarding the motion of the smart credential, such as time-stamps of handshakes with one or more beacons, or time-stamps of events observed within the motion of the smart credential, e.g., changes in acceleration, velocity or position of the smart credential, may be identified. At box 850, the attributes of the motion and the temporal data are processed to generate a gait-based signature, e.g., based on periodic accelerations, velocities or changes in position, or based on an output received from one or more machine learning systems or tools to which the attributes of motion captured at box 840 and the temporal data identified at box 845 are provided as inputs.

At box 855, the gait-based signature generated at box 850 is compared to the gait-based signature of the user accessed from the one or more data stores. At box 860, whether the generated gait-based signature is consistent with the stored gait-based signature is determined. For example, a confidence score or other measure of tolerance or consistency between the generated gait-based signature and the stored gait-based signature may be calculated. In such embodiments, whether the generated gait-based signature is consistent with the stored gait-based signature may be determined with respect to the threshold.

If the generated gait-based signature is inconsistent with the stored gait-based signature, e.g., where a confidence score calculated based on a comparison of the generated gait-based signature to the stored gait-based signature falls below a threshold, then the process advances to box 865, where one or more signals are transmitted to authorities (e.g., security personnel) at the secure facility, and to box 870, where the smart credential displays information regarding the signature anomaly on the screen. Based on the motion of the smart credential by the bearer, as compared to previously stored information regarding the motion of the smart credential by the user, whether the smart credential is being worn, carried or used by the user, or by another bearer who may not share the same levels of qualification or access as the user, may be determined. The smart credential may display information indicating that the bearer of the smart credential is not authorized for access to a given facility or system, such as is shown in FIG. 5C. The smart credential may also generate one or more signals indicating that the bearer of the smart credential is not the user associated with the smart credential, and transmit the one or more signals to one or more external computer devices or systems over one or more networks. At box 895, the bearer's access to the secure facility is revoked, and the process ends.

If the generated gait-based signature is consistent with the stored gait-based signature, e.g., where a confidence score calculated based on a comparison of the generated gait-based signature to the stored gait-based signature meets or exceeds a threshold, then the process advances to box 875, where the bearer is confirmed to be the user associated with the smart credential. At box 880, whether a handshake is maintained with one or more beacons at the secure facility is determined. If a handshake is maintained with one or more beacons at the secure facility, the bearer is presumed to remain within the secure facility, and the process returns to box 840, where attributes of the motion of the smart credential are captured. The attributes of the motion may be processed along with temporal data to generate another gait-based signature, which may also be compared to the stored gait-based signature to continuously determine whether the bearer of the smart credential is the user associated with the smart credential. By continuously monitoring the motion of the smart credential with respect to the stored gait-based signature, a bearer who is not the user associated with the smart credential may be identified even where the motion of the smart credential may temporarily mimic the stored gait-based signature for brief periods of time.

If the smart credential does not maintain a handshake with one or more beacons at the secure facility, then the process advances to box 885, where the smart credential displays limited information regarding the user on the screen. Such information may include a name or other generic information regarding the user, but need not include any information that is intended for use within the secure facility, and not outside of the secure facility. At box 890, the gait-based signature of the user is updated based on attributes of the motion of the smart credential throughout the secure facility, as determined at box 850. At box 890, the bearer's access to the secure facility is revoked, and the process ends.

Figure 9A:
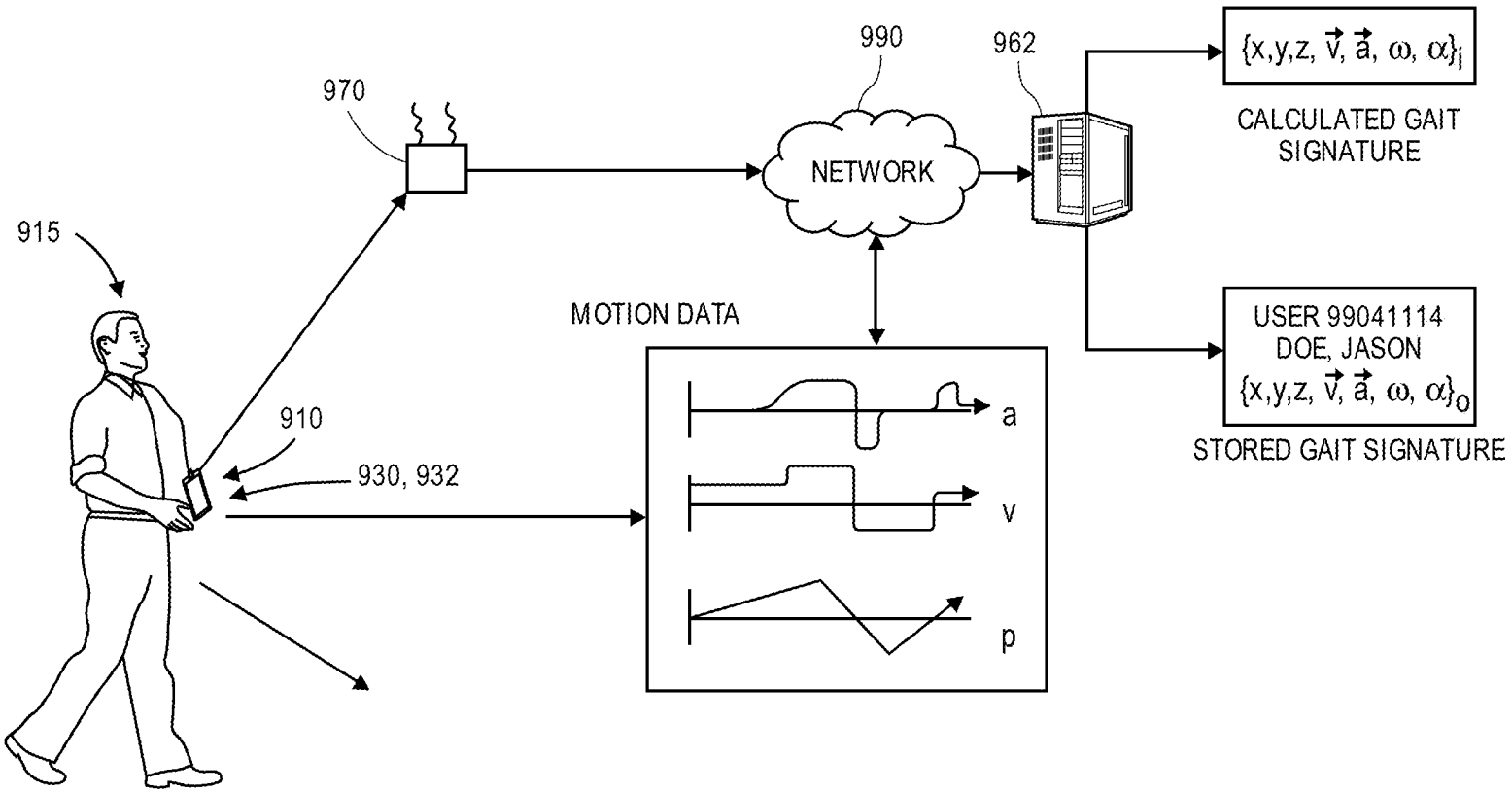
FIGS. 9A and 9B are views of one system for using smart credentials in accordance with embodiments of the present disclosure.
Figure 9B:
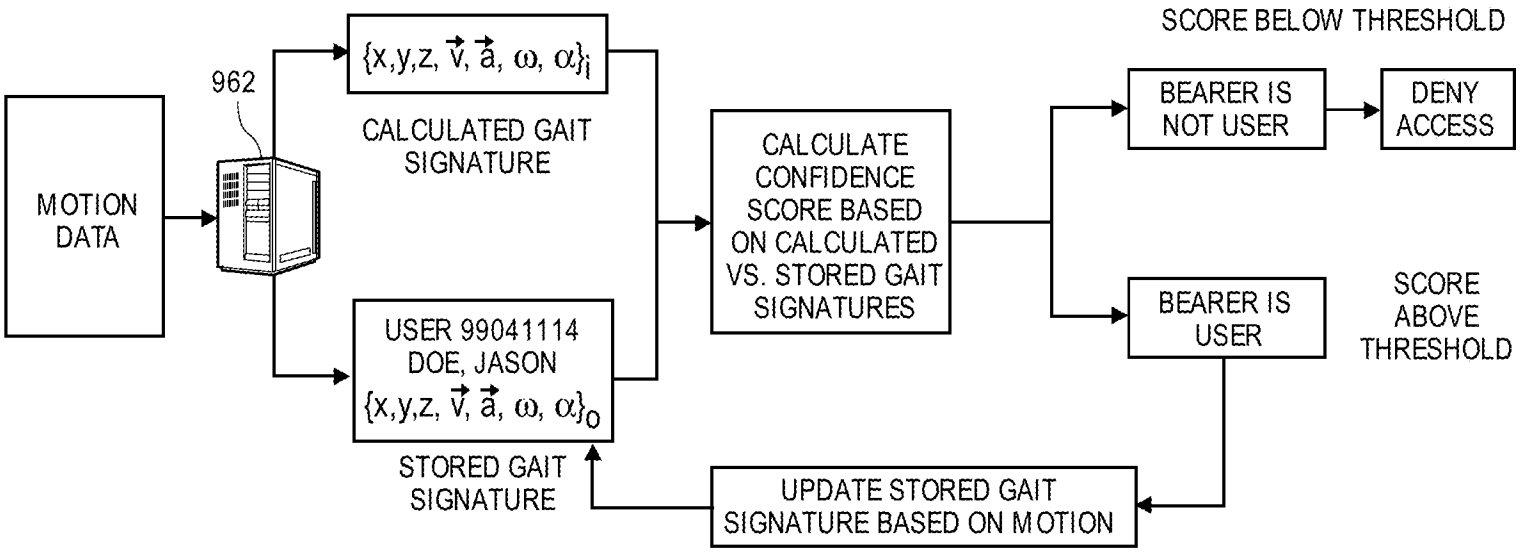

As is discussed above, information or data regarding motion of a smart credential worn or carried by a bearer may be compared to stored information or data regarding motion of an authorized user of the smart credential to determine whether the bearer is the authorized user. Referring to FIGS. 9A and 9B, views of one system for using smart credentials in accordance with embodiments of the present disclosure are shown. Except where otherwise noted, reference numerals preceded by the number "9" in FIGS. 9A and 9B refer to elements that are similar to elements having reference numerals preceded by the number "7" in FIGS. 7A and 7B, by the number "5" in FIGS. 5A, 5B and 5C, by the number "3" in FIGS. 3A and 3B, by the number "2" in FIG. 2A or FIG. 2B, or by the number "1" shown in FIGS. 1A through 1F.

As is shown in FIG. 9A, a smart credential 910 is worn or carried by a bearer 915. The smart credential includes position sensors 930 (e.g., a receiver of signals from one or more beacons) and motion sensors 932. The smart credential 910 completes a handshake with a beacon 970, thereby opening a communications channel between the smart credential 910 and the beacon 970. Information or data regarding the motion of the smart credential 910 may be gathered over time by the position sensors 930 and/or the motion sensors 932, and transmitted to a server 962 over one or more networks 990. The information or data regarding the motion may be used to calculate a signature of a gait or other attributes of motion of the bearer 915. In some embodiments, the signature may be a vector representative of motion of the bearer 915, e.g., by one or more functions representative of linear or rotational motion of joints, limbs or other body parts of the bearer 915 in three-dimensional space. Alternatively, the signature of the gait or the other attributes of the motion of the bearer 915 may be calculated by one or more processors associated with the smart credential 910.

As is shown in FIG. 9B, signatures representative of motion of the bearer 915 may be calculated continuously over time, based on information or data regarding the motion of the smart credential 910 gathered by the position sensors 930 and/or the motion sensors 932. The signatures representative of motion of the bearer 915 may be compared to a previously calculated signature representative of motion of an authorized user of the smart credential 910, in order to determine whether the bearer 915 is the authorized user. For example, as is shown in FIG. 9B, confidence scores representative of similarities or differences between the signatures calculated based on motion of the bearer 915 and the signature representative of motion of the authorized user of the smart credential 910 may be calculated by the server 962 or, alternatively, by one or more processors associated with the smart credential 910, and compared to a threshold. Where a confidence score meets or exceeds the threshold, the bearer 915 is determined to be the authorized user, and the stored gait signature is updated based on the motion before being compared to a gait signature calculated based on the motion of the smart credential. Where a confidence score falls below the threshold, however, the bearer 915 is determined to not be the authorized user, and access to the secure facility by the bearer 915 is revoked.

Figure 10:
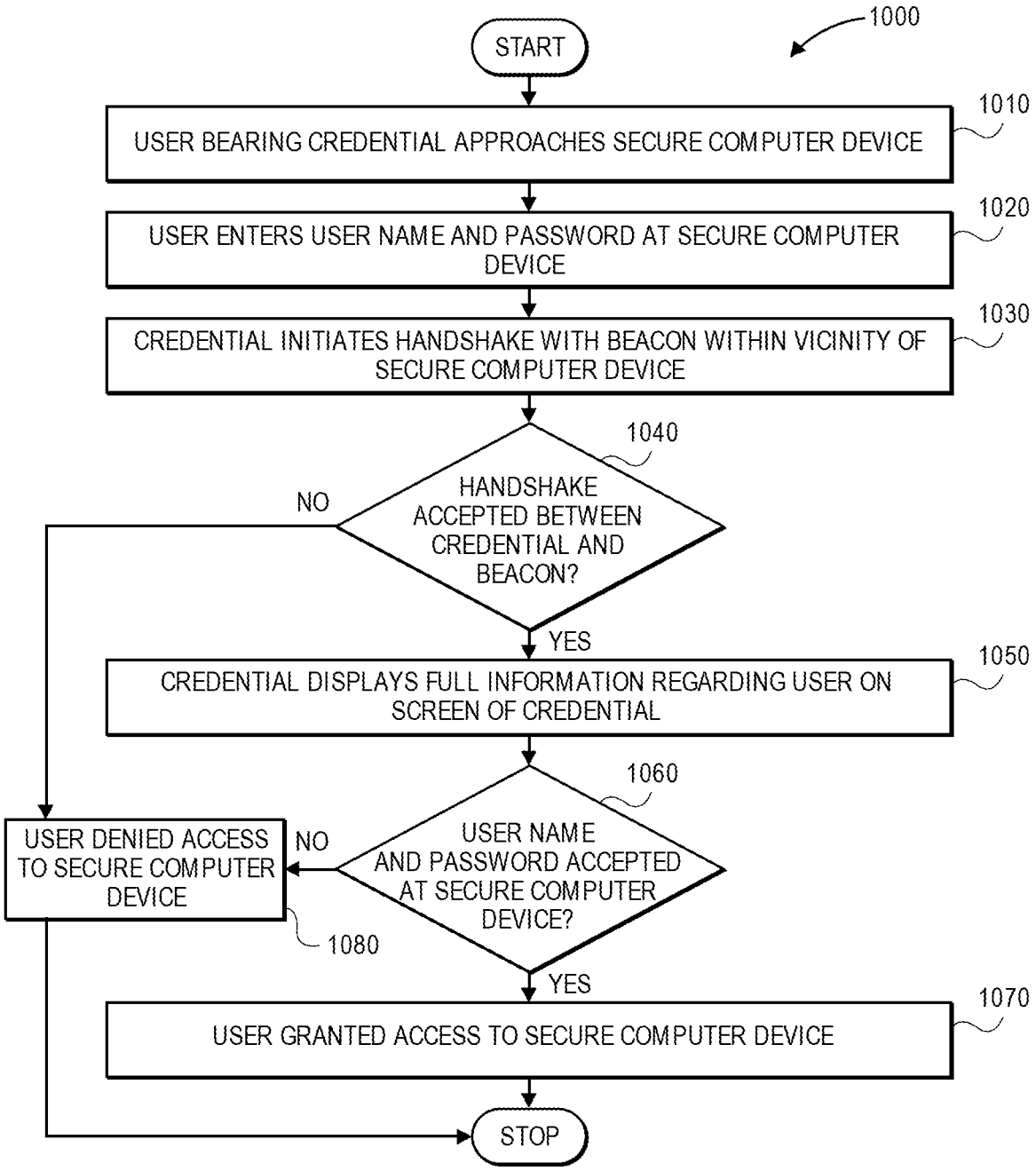
FIG. 10 is a flow chart of one process for using smart credentials in accordance with embodiments of the present disclosure.

The smart credentials of the present disclosure may be used to protect user information while enabling access not only to secure facilities but also to secure computer systems. For example, upon successfully completing a handshake between a smart credential and a beacon associated with a secure computer system, the handshake may act as one factor in either a single factor or a multi-factor authorization process. Referring to FIG. 10, a flow chart 1000 of one process for using smart credentials in accordance with embodiments of the present disclosure is shown. At box 1010, a user bearing a smart credential approaches a secure computer device, and at box 1020, the user enters a user name and a password at the secure computer device. The smart credential may include a frame, a display and one or more processors, memory components, transceivers, and other components, and may be configured in accordance with one or more of the embodiments disclosed herein. Alternatively, the user may provide biometric data, e.g., by interacting with a biometric sensor provided on a smart credential or in one or more other locations.

At box 1030, the smart credential initiates a handshake with a beacon within a vicinity of the secure computer device, e.g., by transmitting one or more packets of information or data by the smart credential to the beacon, or by the beacon to the smart credential, over one or more networks. At box 1040, whether the handshake is accepted between the smart credential and the beacon is determined. If the handshake is not accepted, then the process advances to box 1080, where the user is denied access to the secure computer device, and the process ends. For example, where a handshake between the smart credential and the beacon fails or is refused, the handshake is unsuccessful.

If the handshake is accepted, however, the process advances to box 1050, where full information regarding the user is displayed on a screen. As is discussed above, the acceptance of the handshake is a confirmation that the user is authorized to be within a vicinity of the beacon, and results in a display of information that may be relevant and/or required in that area. Additionally, the acceptance of the handshake acts as a first factor for authorizing the user to access the secure computer system.

At box 1060, whether the user name and the password are accepted at the secure computer device is determined. If the user name and the password are not accepted at the secure computer device, the process advances to box 1080, where the user is denied access to the secure computer device, and the process ends. If the user name and the password are accepted at the secure computer device, however, the process advances to box 1070, where the user is granted access to the secure computer device, and the process ends. For example, in some embodiments, the user name entered at box 1020 need only match the password entered at box 1020 following the acceptance of the handshake between the smart credential and the beacon in order for the user to be granted access to the secure computer device. In some other embodiments, however, the user name entered by the user at box 1020 must not only match the password entered by the user at box 1020, but also be consistent with the identity of the user associated with the smart credential, as determined by the handshake, in order for the user to be granted access to the secure computer device.

Figure 11A:
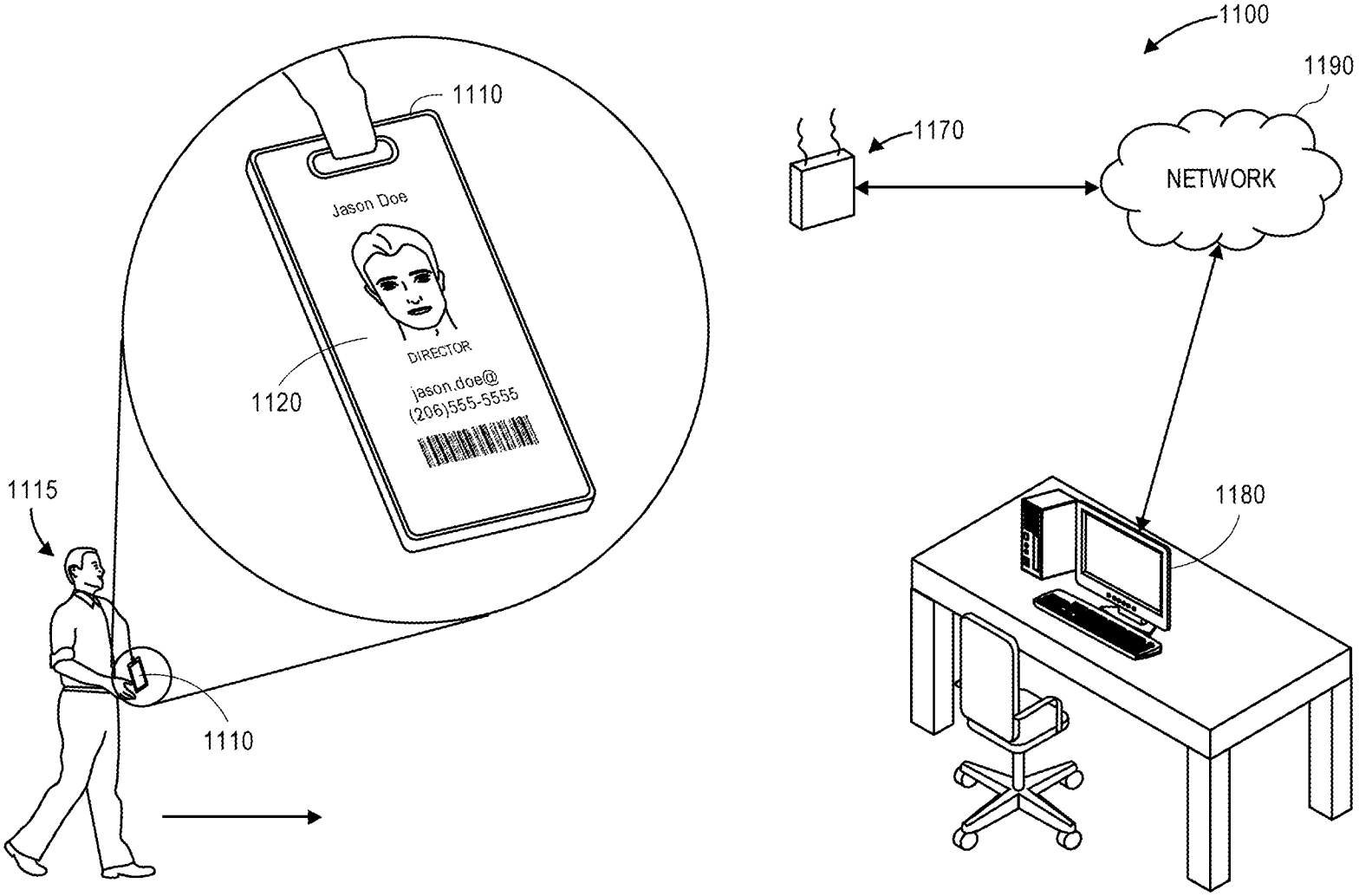
FIGS. 11A and 11B are views of one system for using smart credentials in accordance with embodiments of the present disclosure.
Figure 11B:
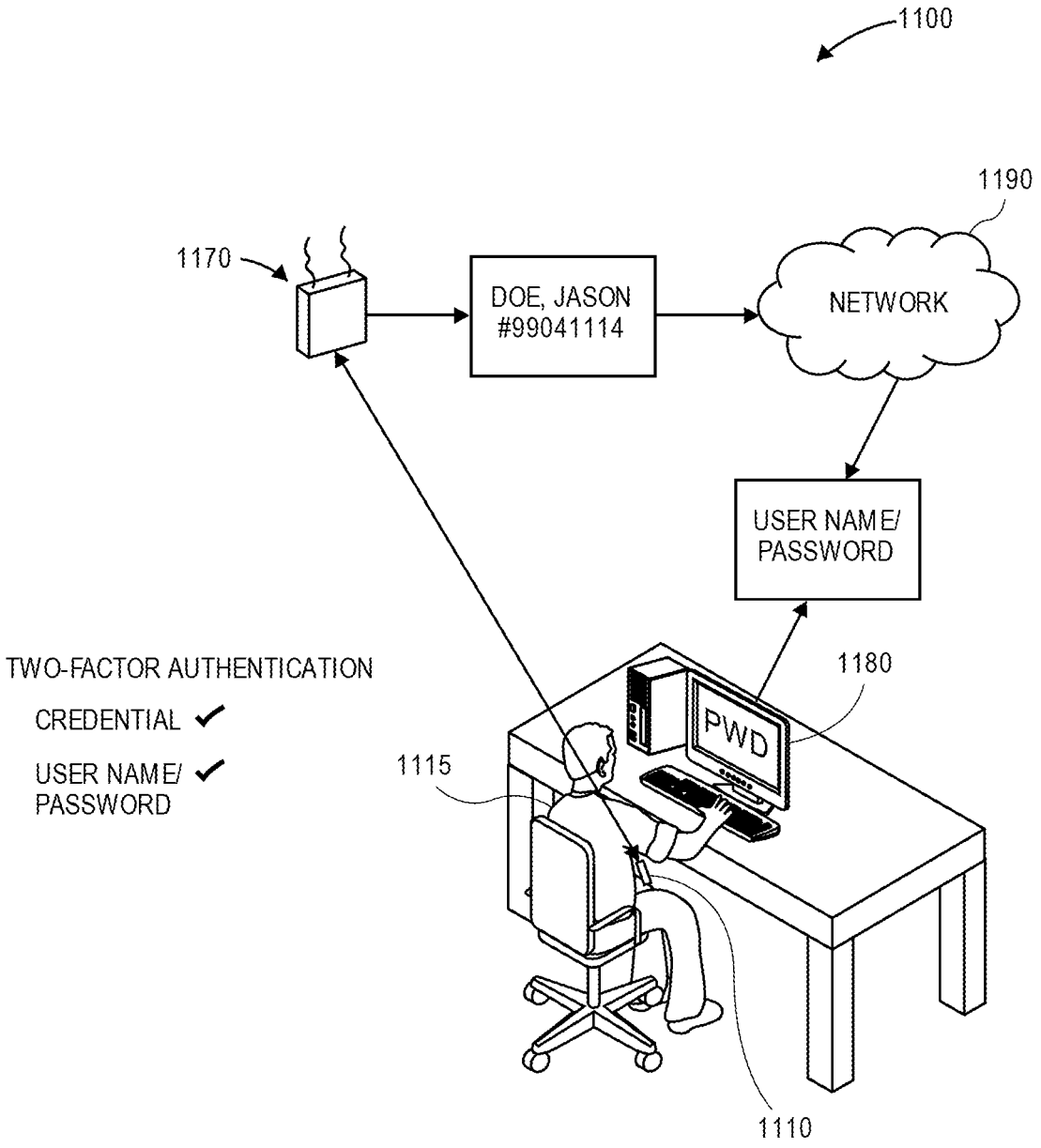

Referring to FIGS. 11A and 11B, views of one system for using smart credentials in accordance with embodiments of the present disclosure are shown. Except where otherwise noted, reference numerals preceded by the number "11" in FIG. 11A or FIG. 11B refer to elements that are similar to elements having reference numerals preceded by the number "9" in FIGS. 9A and 9B, by the number "7" in FIGS. 7A and 7B, by the number "5" in FIGS. 5A, 5B and 5C, by the number "3" in FIGS. 3A and 3B, by the number "2" in FIG. 2A or FIG. 2B, or by the number "1" shown in FIGS. 1A through 1F.

As is shown in FIG. 11A and FIG. 11B, a system 1100 includes a smart credential 1110, a beacon 1170 and a computer system 1180 that may be connected to one another over one or more networks 1190. The smart credential 1110 is worn by a user 1115, e.g., by way of a chain or a lanyard that is connected to the smart credential 1110 and wrapped around one or more body parts of the user 1115.

As is shown in FIG. 11A, the user 1115 approaches a computer system 1180 that is connected to a network 1190. The smart credential 1110 includes information 1125 regarding the bearer 1115 on a display 1120, viz., a name of the user 1115, an image of the user 1115, a title of the user 1115, an electronic mail address or alias of the user 1115, and a telephone number of the user 1115, as well as an optically readable bar code that may be linked with any additional information regarding the user 1115.

As is shown in FIG. 11B, when the user 1115 arrives at the computer system 1180, the smart credential 1110 initiates a handshake with the beacon 1170. Simultaneous to the initiation of the handshake, or prior to or after the handshake, the user 1115 enters a user name and password or other authenticator at the computer system 1180. Alternatively, the user may provide biometric data at the computer system 1180, e.g., by way of one or more components of the smart credential 110, or one or more external systems in communication with the computer system 1180. Upon a successful completion of the handshake, the beacon 1170 transmits information regarding the user 1115 to the computer system 1180 over the network 1190. Based on a match between the user name and password, or any other authenticator (e.g., biometric data), and on the successful completion of the handshake, the user 1115 is granted access to the computer system 1180. If the handshake were to fail or not be accepted, or if the user name did not match the password, then the user 1115 would be denied access to the computer system 1180.

As used herein, the term "credential," "badge," "tag," or like terms refer to any wearable or portable device for displaying information regarding a user, including but not limited to names, images, titles, statuses or the like. The terms "credential," "badge," "tag," or like terms may be used interchangeably herein. As used herein, the term "bearer," "user" or "employee" may refer to any individual or entity that is wearing, carrying or otherwise transporting a smart credential. As is discussed above, a bearer, a user or an employee of a smart credential may or may not be an authorized user associated with the smart credential.

One or more of the smart credentials disclosed herein may be utilized for any purpose and in any applications, and the systems and methods of the present disclosure are not limited to merely enabling access to one or more secure facilities. For example, in some embodiments, information or data determined using one or more of the smart credentials of the present disclosure may be utilized to determine rates of utilization of specific facilities, areas or spaces in an environment, or to determine paths typically traveled by personnel within such facilities, areas or spaces. In some embodiments, information or data determined using one or more of the smart credentials of the present disclosure may be integrated with climate control systems in a given environment in order to ensure that such systems are operating when and where, and only when and where, facilities, areas or spaces within the environment are occupied by one or more users, or to tailor environmental conditions generated by such systems to preferences, requirements or restrictions associated with users occupying such facilities, areas or spaces.

Although the disclosure has been described herein using exemplary techniques, components, and/or processes for implementing the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure.

It should be understood that, unless otherwise explicitly or implicitly indicated herein, any of the features, characteristics, alternatives or modifications described regarding a particular embodiment herein may also be applied, used, or incorporated with any other embodiment described herein, and that the drawings and detailed description of the present disclosure are intended to cover all modifications, equivalents and alternatives to the various embodiments as defined by the appended claims. Moreover, with respect to the one or more methods or processes of the present disclosure described herein, including but not limited to the flow charts shown in FIGS. 4, 6, 8A and 8B, and 10, the order in which the boxes or steps of the methods or processes are listed is not intended to be construed as a limitation on the claimed inventions, and any number of the boxes or steps can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain embodiments could include, or have the potential to include, but do not mandate or require, certain features, elements and/or boxes or steps. In a similar manner, terms such as "include," "including" and "includes are generally intended to mean "including, but not limited to." Thus, such conditional language is not generally intended to imply that features, elements and/or boxes or steps are in any way required for one or more embodiments or that one or more embodiments necessarily include logic for deciding, with or without user input or prompting, whether these features, elements and/or boxes or steps are included or are to be performed in any particular embodiment.

Although the invention has been described and illustrated with respect to exemplary embodiments thereof, the foregoing and various other additions and omissions may be made therein and thereto without departing from the spirit and scope of the present disclosure.

What is claimed is:

1. A method for controlling access to a facility comprising:

causing a display of first information regarding a user on a display of a smart credential at a first time, wherein the first information comprises a name of the user;

initiating a handshake between the smart credential and a communications beacon at a second time, wherein the communications beacon is within a vicinity of a point of access to the facility, wherein the smart credential is worn or carried by a bearer at the second time, and wherein the second time follows the first time;

determining that the handshake between the smart credential and the communications beacon was successful;

in response to determining that the handshake was successful, confirming that the user is authorized to access at least a portion of the facility;

selecting second information regarding the user based at least in part on at least one of:

a location of the access point; or a task to be performed by the user in association with the portion of the facility, wherein the second information comprises the name of the user, an image of the user and contact information for the user;

causing a display of the second information regarding the user on the display of the smart credential; and granting access to at least the portion of the facility to the bearer at a third time, wherein the third time follows the second time, and wherein the first information does not comprise the image of the user or the contact information for the user.

2. The method of claim 1, wherein the smart credential further comprises at least one accelerometer, and wherein the method further comprises:

capturing data regarding motion of the smart credential in association with the portion of the facility by the at least one accelerometer;

generating a first signature based at least in part on the data regarding the motion captured by the at least one accelerometer;

identifying a second signature associated with the user;

calculating a confidence score based at least in part on the first signature and the second signature;

determining that the confidence score is less than a predetermined threshold;

in response to determining that the confidence score is less than the predetermined threshold, causing a display of third information on the display, wherein the third information indicates that the bearer is not the user.

3. The method of claim 1, wherein granting access to at least the portion of the facility to the bearer at the third time comprises:

transmitting a first message from one of the smart credential or the communications beacon to at least one server associated with at least the portion of the facility, wherein the first message comprises an indication that the user accessed at least the portion of the facility via the point of access at the second time.

4. The method of claim 1, wherein the smart credential comprises a frame having a processor, a memory component, a transceiver and the display disposed within the frame, wherein the frame is formed from at least one of an epoxy, a phenolic resin, a polyurethane, a polyester, a polyethylene, a polypropylene or a polyvinyl chloride, aluminum, steel or an alloy comprising at least one of aluminum or steel, wherein the frame has a first dimension between a range of one inch to two-and-one-half inches, a second dimension between a range of two inches to three-and-one-half inches, and a third dimension of less than one-half inch, wherein the smart credential is associated with the bearer by at least one of a clip, a chain or a lanyard coupled to the frame, and wherein the display is one of an electronic ink display, a liquid crystal display or a light-emitting diode display.

5. A method comprising:

causing a display of first information regarding a user by a credential, wherein the credential comprises a frame having at least a display, a memory component, a transceiver and at least one processor disposed within the frame;

opening a first wireless communications channel between the credential and at least a first beacon associated with at least one access point at a facility;

in response to opening the first wireless communications channel, determining whether the user is authorized to access at least a portion of the facility;

in response to determining that the user is authorized to access at least the portion of the facility, selecting second information regarding the user, wherein the second information relates to at least one of the facility, the at least one access point or the first beacon, and wherein the first information does not include at least some of the second information; and causing a display of the second information by the credential, wherein at least the first information and the second information is stored on the memory component.

6. The method of claim 5, wherein the first information comprises at least a portion of a name of the user, and wherein the second information comprises the name of the user and at least one of:

an image of the user;

an identifier of the user;

contact information of the user.

7. The method of claim 5, wherein the credential further comprises a position sensor disposed within the frame, and wherein the method further comprises:

prior to causing the display of the first information regarding the user by the credential, determining, by the position sensor, that the credential is within a vicinity of one of the at least one access point or the facility; and in response to determining that the credential is within the vicinity of the one of the at least one access point or the facility, selecting the first information; and causing the display of the first information by the credential.

8. The method of claim 5, wherein determining whether the user is authorized to access at least a portion of the facility comprises:

determining whether the user is authorized to perform a task or access a location within the portion of the facility, wherein the second information comprises information regarding the task or the location, and wherein the first information does not include information regarding the task or the location.

9. The method of claim 5, further comprising:

opening a second wireless communications channel between the credential and at least a second beacon associated with at least one space within the facility; and in response to opening the second wireless communications channel, selecting third information regarding the user, wherein the third information relates to the at least one space within the facility, and wherein the third information does not include at least some of the second information; and causing a display of the third information by the credential.

10. The method of claim 9, wherein at least a portion of the second information is associated with access to at least the portion of the facility, and wherein at least a portion of the third information is not associated with access to the portion of the facility.

11. The method of claim 5, further comprising:

determining that the first wireless communications channel is closed; and in response to determining that the first wireless communications channel is closed, causing a display of the first information by the credential.

12. The method of claim 5, wherein the frame is formed from at least one of an epoxy, a phenolic resin, a polyurethane, a polyester, a polyethylene, a polypropylene or a polyvinyl chloride, aluminum, steel or an alloy comprising at least one of aluminum or steel, and wherein the display is one of an electronic ink display, a liquid crystal display or a light-emitting diode display.

13. The method of claim 5, wherein at least one of a clip, a chain or a lanyard is coupled to the frame, and wherein the credential is associated with a bearer by the at least one of the clip, the chain or the lanyard.

14. The method of claim 5, wherein the credential further comprises a motion sensor disposed within the frame, and wherein the method further comprises:

capturing data regarding linear or rotational motion of the credential by the motion sensor;

generating a first signature representative of the linear or rotational motion by the at least one computer processor;

identifying a second signature associated with the user of the credential;

determining that the first signature is not consistent with the second signature; and in response to determining that the first signature is not consistent with the second signature, at least one of:

transmitting at least one message indicating that a bearer of the credential is not the user to at least one computer system over a network;

causing a display of third in formation by the credential, wherein the third information does not include any of the second information; or generating feedback by at least one feedback device disposed within the frame, wherein the feedback indicates that the bearer is not the user.

15. The method of claim 5, wherein opening the first wireless communications channel comprises:

transmitting, by the credential to the first beacon, a first message;

receiving, by the credential from the first beacon, a second message, wherein the second message is an acknowledgement of the first message; and transmitting, by the credential to the first beacon, a third message, wherein the second message is an acknowledgment of the second message, wherein each of the first message, the second message and the third message is transmitted or received according to a common protocol, and wherein whether the user is authorized to access at least the portion of the facility is determined following the transmission of the third message.

16. A credential comprising:

a frame;

a display disposed within the frame;

a transceiver disposed within the frame;

a memory component disposed within the frame, wherein the memory component has information regarding a user associated with the credential stored thereon; and a processor disposed within the frame, wherein the memory component is programmed with one or more sets of instructions that, when executed, cause the credential to execute a method comprising:

causing a display of a first subset of the information regarding the user on the display;

executing a handshake with a beacon associated with a secure facility; and confirming that the user is authorized to access at least a portion of the secure facility based at least in part on the handshake;

in response to confirming that the user is authorized to access at least the portion of the secure facility, selecting a second subset of the information regarding the user based at least in part on at least one attribute of the secure facility;

removing the display of the first subset of the information regarding the user from the display; and causing a display of at least the second subset of the information regarding the user on the display.

17. The credential of claim 16, wherein the frame is formed from at least one of an epoxy, a phenolic resin, a polyurethane, a polyester, a polyethylene, a polypropylene or a polyvinyl chloride, aluminum, steel or an alloy comprising at least one of aluminum or steel, wherein the frame has a first dimension between a range of one to two-and-one-half inches, a second dimension between a range of two to three-and-one-half inches, and a third dimension of less than one-half inch, wherein the credential is associated with a bearer by at least one of a clip, a chain or a lanyard coupled to the frame, and wherein the display is one of an electronic ink display, a liquid crystal display or a light-emitting diode display.

18. The credential of claim 16, wherein the second subset of the information regarding the user comprises a name of the user, and at least one of:

an image of the user;

a title of the user; and contact information for the user, and wherein the first subset of the information regarding the user does not include the image of the user, the title of the user or the contact information for the user.

19. The credential of claim 16, wherein the method further comprises:

in response to confirming that the user is authorized to access at least the portion of the secure facility, transmitting at least one message at least one server associated with the secure facility, wherein the at least one message comprises:

an identifier of the user;

a date or a time at which the handshake was executed; and a location of the beacon or the secure facility.

20. The credential of claim 16, wherein executing the handshake comprises:

transmitting, to the beacon, a synchronization message;

receiving, from the beacon, a first acknowledgment message acknowledging the synchronization message; and transmitting, to the beacon, a second acknowledgment message acknowledging the first acknowledgment message, wherein that the user is authorized to access at least the portion of the secure facility is confirmed in response to transmitting the second acknowledgment message.

* * * * *